US006698748B1

(12) United States Patent
Crowley

(10) Patent No.: US 6,698,748 B1
(45) Date of Patent: Mar. 2, 2004

(54) SYSTEM AND METHOD FOR SINGULATING A STACK OF SHEET-LIKE MATERIALS

(75) Inventor: H. W. Crowley, 7 Osprey Cove, Eliot, ME (US) 03903

(73) Assignee: H. W. Crowley, Eliot, ME (US)

( * ) Notice: Subject to any disclaimer, the term of this patent is extended or adjusted under 35 U.S.C. 154(b) by 135 days.

(21) Appl. No.: 09/962,392

(22) Filed: Sep. 25, 2001

Related U.S. Application Data

(60) Provisional application No. 60/235,125, filed on Sep. 25, 2000.

(51) Int. Cl.[7] ..... B65H 3/30

(52) U.S. Cl. ..... 271/98; 271/99; 271/23; 271/35; 271/165

(58) Field of Search ..... 271/23, 99, 35, 271/165, 208, 90, 5, 11, 20, 112, 132, 211, 278, 91, 92, 93, 94, 196, 95, 120, 96, 108, 97, 104, 105, 195, 98, 100

(56) References Cited

U.S. PATENT DOCUMENTS

| | | | | | |
|---|---|---|---|---|---|
| 15,293 | A | * | 7/1856 | Bombard | 271/35 |
| 1,948,362 | A | * | 2/1934 | Stude | 271/35 |
| 2,325,455 | A | | 7/1943 | Williams | |
| 3,151,863 | A | * | 10/1964 | Lohr | 271/121 |
| 3,622,149 | A | * | 11/1971 | Enskat | 271/35 |
| 3,902,712 | A | * | 9/1975 | Dorer | 271/125 |
| 4,010,944 | A | * | 3/1977 | Young | 271/99 |
| 4,630,812 | A | * | 12/1986 | Yano et al. | 271/132 |
| 4,657,236 | A | * | 4/1987 | Hirakawa et al. | 271/99 |
| 5,150,560 | A | | 9/1992 | Crowley | |
| 5,282,350 | A | | 2/1994 | Crowley | |
| 5,478,185 | A | * | 12/1995 | Kranz | 414/331.13 |
| 5,498,123 | A | * | 3/1996 | Alicea | 414/797.7 |
| 5,626,001 | A | * | 5/1997 | Belec | 53/284.3 |
| 5,642,877 | A | * | 7/1997 | Green | 271/35 |
| 5,772,199 | A | * | 6/1998 | Green | 271/10.06 |
| 6,390,461 | B1 | | 5/2002 | Vitko, Jr. et al. | |
| 6,416,047 | B1 | * | 7/2002 | Pfankuch | |

FOREIGN PATENT DOCUMENTS

| | | | | |
|---|---|---|---|---|
| GB | 2 092 556 A | * | 8/1982 | B65H/3/04 |
| JP | 4-12944 | * | 1/1992 | B65H/3/24 |
| JP | 5-105251 | * | 4/1993 | B65H/3/04 |

OTHER PUBLICATIONS

SIMCO Industrial Static Control—Applications—"Static Problems on Sheet Fed Presses"—Available at http://www.simco–static.com/simco/applications.asp on Apr. 25, 2003.*

Bell & Howell, 1975, Phillipsburg Expediter Imperial 10,000 Reference Guide, all pages.

Bell & Howell Phillipsburg, 1990, MAILSTAR 775 Catalog, Issue L, all pages.

* cited by examiner

*Primary Examiner*—Donald P Walsh
*Assistant Examiner*—Kenneth W Bower
(74) *Attorney, Agent, or Firm*—Cesari and McKenna, LLP; William A. Loginov

(57) ABSTRACT

An improved hopper and singulating/feed assembly for a utilization device, such as an inserter, that feeds sheet-like materials from a hopper feed stack that reduces the various geometrical and physical problems that lead to jams, misfeeds and failures to properly singulate the stack is provided. A hopper reduces the pressure on the bottom sheets of the stack by providing a parallel wedge structure at the stack base. This wedge structure also helps to drive bottom sheets successively forward toward a front face so as to further break frictional and adhesive contact between sheets at the bottom of the stack. Hopper side guides with integral angled shelves engage front side edges of the stack and allow easier singulation of respective bottom sheets. Likewise a fixed sucker block assembly, which seats a suction cup in a rotating base with a surrounding planar block face and an integral fulcrum edge improves the separation of the bottom sheet from the overlying stack. The block face is adjusted to lift the stack upon engagement for further aid in singulation. This block is also fixed in rotation and vertical position with respect to the stack, requiring no continual adjustment. There are also lower shelves upon which the sheet is driven as the sucker rotates away from the stack that have non-parallel sides to avoid binding, and more accurately locate the sheets for subsequent draw into a raceway by a gripper/plucker assembly.

20 Claims, 22 Drawing Sheets

Fig. 9
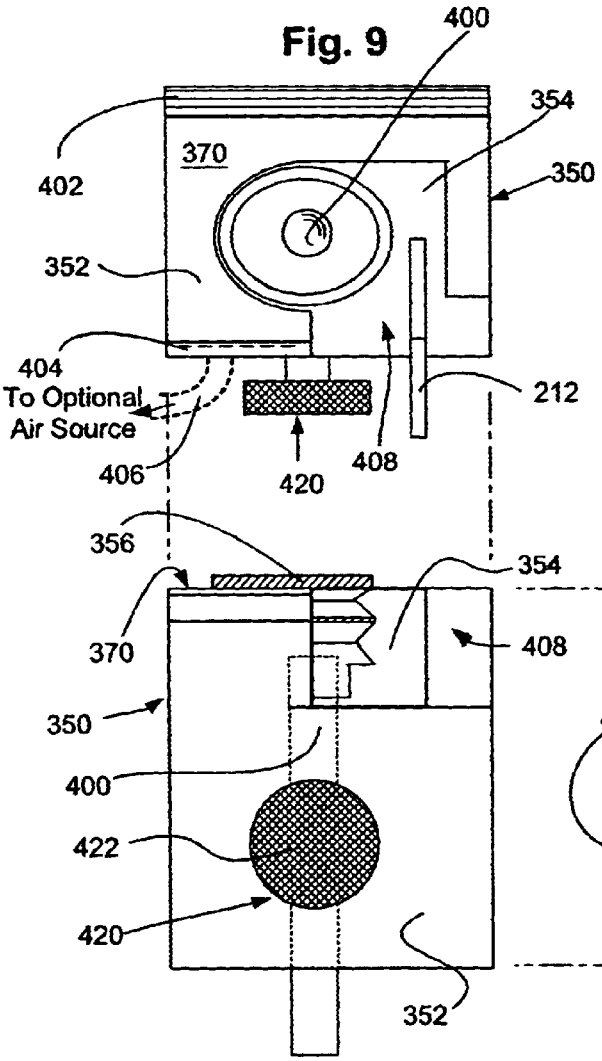
Fig. 10
Fig. 11
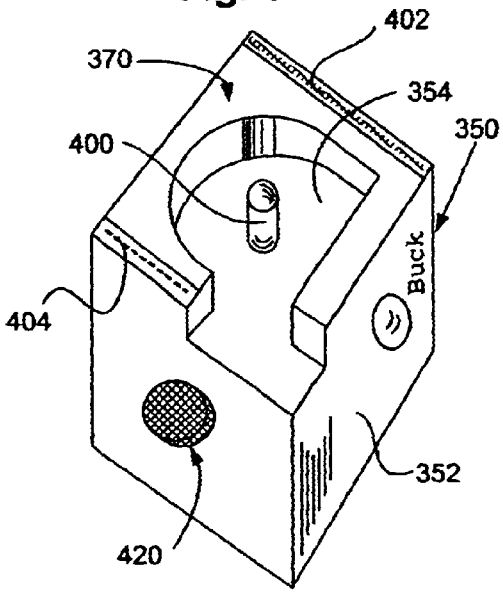
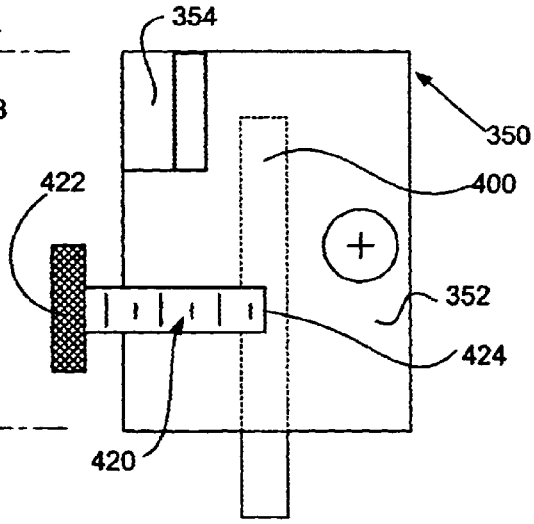
Fig. 12

SYSTEM AND METHOD FOR SINGULATING A STACK OF SHEET-LIKE MATERIALS

CROSS-REFERENCE TO RELATED APPLICATION

The present application claims the benefit of U.S. Provisional Patent Application Serial No. 60/235,125, which was filed on Sep. 25, 2000, by H. W. Crowley entitled SINGULATING A STACK OF ITEMS and is hereby incorporated by reference.

BACKGROUND OF THE INVENTION

1. Field of the Invention

This invention relates to feed mechanisms and methods for feeding sheets and envelopes from a stack into a utilization device.

2. Background Information

Current estimates place the number of envelopes used annually in the United States at over 100 billion. A significant percentage of these envelopes are used in connection with bulk mailings, and are accordingly filled, addressed and processed by a variety of automated machines. A lynchpin of all automated processes is the automatic envelope inserter. Automatic inserters are large, complex machines that are loaded with contents to be inserted (e.g., individual letter sheets and/or fillers) and envelopes in which these contents are to be inserted. Other machines such as binders, that bind inserts together (into a books, catalogs, newspapers or magazines), presses that apply logos and decoration, addressing machines, collating and a variety of other machines are also used selectively to process individual sheet-like materials in bulk mailing and other processes. These various devices can be termed generally "utilization devices" as they utilize sheet-like materials that are typically dispensed in stacks.

FIG. 1 shows a high-volume envelope inserter in current use by industry. The exemplary inserter 100 is a large, modular unit that combines various contents stored in hoppers (not shown) in the rear 102 of the machine and that directs (arrows 104 and 106) contents 105 onto a raceway 108 downstream (arrow 110) toward a stack of envelopes 112. At each point along the raceway, additional insert sheets are added to the contents. These contents may be folded, or otherwise compacted, to fit within the selected envelope by mechanism within the inserter. Envelopes are drawn from the stack 112, and directed downstream (arrow 114) to a inserting station 116 at which the closed-but-unsealed envelope flaps 118 are opened so that the final contents 120 can be inserted thereinto. The filled envelopes 122 are then transferred further downstream (arrow 124) to a stacking position or further-processing module (not shown).

Industrial inserters, referred to generically as swing-arm inserters, are available from a variety of well-known companies including Bell & Howell (Phillipsburg), as well as by Mailcrafter (Inserco model), Pitney Bowes (AMOS model), EMC Document System (Conquest Lsi model) and H M Surchin (Cornish model). A rotary variation is made by Buhrs (BB300 and BB 500) series. One more-specific example is the Bell & Howell Imperial™.

Most inserters cycle at least 10,000 per hour without any material. However, once the various hopper materials are inserted into the envelopes, the net production is significantly slower. Due to paper handling problems, swing-arm inserters often net less than one third of their capabilities. A typical swing-arm machine in production may net less than 3000 completed envelopes per hour. After careful study, it is now recognized that the primary cause is the unreliable feeding of materials from the hoppers onto the collating raceway. The hopper is subject to jams, double feeds and no feeds. The design of these hoppers has not changed significantly in 30 years. And for that matter, they have changed little since their invention 60 years ago, as exemplified by U.S. Pat. No. 2,325,455.

With reference to FIG. 1, the envelope stack 112, the stacking location or "feed station" 130 consists of a series of upright guide rails 132, 134 that, respectively, contain the four opposing sides of each envelope in the stack.

As also shown in FIG. 1, the contents 105 entering the raceway originate from separate feed hoppers 150, 152, and 154. The hoppers include separate stacks of folded or unfolded sheet material 158. Each stack 158 represents a piece of the total inserted package 120 to be provided to the downstream envelope 118. The number of hoppers used varies based upon the number of content sheets to be inserted. For the purposes of illustration, further reference will be made to the hopper 154, which is the first hopper along the raceway 108. The hopper includes a rear backing guide 160 and a pair of front corner guides 162. The guides 160 and 162 essentially contain the stack of materials 158 so that bottom sheets can be stripped and directed (arrow 104) one at a time into the raceway 108.

With further reference to FIGS. 2–6, a content feed hopper and associated feeding and singulating assembly is shown in further detail, according to a prior art implementation. The stack of sheet-like materials (envelope inserts) 158 is confronted by a front stop 170 that retains the stack against forward movement into the raceway area. The stack is suspended at its rear (adjacent to the rear guide 160) by a partial floor 172. An opening 174 is defined between the front edge of the floor 172 and the front stop 170. This opening defines the region through which bottom sheets 176 are allowed to pass out of the stack and into the raceway, as will be described. At the bottom of the front stop 170 is located an adjustable pin 180 that is implemented as a threaded thumb screw with a projecting conical point 182. As shown in the plan view of FIG. 6, there are two pins 180 located at a horizontal spacing along the front stop 170. These pins are used to retain the front end of the stack of materials 158 from entering the opening 174. The pins are adjusted fairly finely because the points, if overly retracted, will not support the stack, while if overly projecting, will tear or prevent the bottom sheet 176 from passing over the pin 182 and into the opening when needed.

More particularly, FIGS. 3–5 show the general sequence by which a conventional vacuum sucker assembly 190 is used to draw bottom sheets 176 from the stack of materials 158. The sucker assembly 190 consists of a moving bracket arm 192 mounted on a common rotating shaft 194. In the illustrated example, the shaft moves an associated sucker assembly on each feed hopper simultaneously. The operative element of the sucker assembly 190 is a vacuum lead tube 196 that is adjustable upwardly and downwardly (double arrow 198 in FIG. 2) and rotationally (double curved arrow 200 in FIG. 2) using associated turn screws 202 and 204, respectively. These adjustments bring a suction cup 210 at the end of the feed tube 196 into a desired alignment with respect to the bottom of the stack. As will be described, these adjustments are problematic, and must be attended to regularly.

Referring to the feed operation in FIG. 3, the suction cup 210 engages the bottom sheet 176 and then draws it downwardly in a rotational motion as shown beneath the bottom edge of the front stop 170, having overcome the holding force of the pin point 182—in a generally downward-peeling motion away from the overlying stack. A moving hold-down finger 212 retracts to allow the rotational downward movement of the sheet 176, and then returns to the position shown in FIG. 3, in which it interferes with any return upward movement of the sheet 176. In accordance with FIG. 4, once the finger 212 is brought back into interfering contact with the sheet 176, the suction cup drops its vacuum and continues on its rotational path away from interference with the sheet 176. Just prior to the disengagement, a jawed gripper or "plucker" assembly 220 moves into engagement with the forward edge of the sheet 176. The forward edge has been restrained by the finger 212 to enable an accurate grip upon the sheet 176. Once grip is achieved, the mechanism causes the upper jaw 222 to close against the lower jaw 224, and thereby firmly grasp the sheet. The gripper assembly 220 then rotates as shown in FIG. 5 (double arrow 226). When the gripper assembly 220 has swung sufficiently, the upper jaw and lower jaw, 222 and 224, pass between a set of stripper guides 230 that, in this example are a pair of upright, angled plates. The stripped guides engage the front edge of the sheet 176 at approximately the same time that the upper jaw 222 of the assembly 220 opens with respect to the lower jaw 224. The sheet, hence, is unable to move past stripper guides and is forced to fall away from the gripper assembly 220 and into the raceway 108. It becomes captured by opposing edge guides 232 and 234 and is moved along the raceway by a set of chain lugs 240 that push the upstream edge in a downstream direction (arrow 244 in FIG. 6).

As described generally above, the removal of sheets from the hopper stack involves accurate and complex sequential phasing of the individual mechanism elements. If any element is out of time or not accurately aligned, the fed sheets may become jammed or otherwise fail to feed properly. For example, the pins 182, while supporting the stack 158, and allowing singulation of the bottom sheet 176, often do so at the expense of producing a tear in the sheet as it is peeled past the pin's sharp points. These two screw-adjusted pins are independently operator adjustable and since they are tapered, interact with the chosen sucker height adjustment—the sucker itself being subject to several adjustments that further contemplate the delicate balance.

Specifically, the sucker requires two difficult, interrelated operator adjustments, one to tilt the sucker in-and-out and the other to raise it up-and-down. Due to the interrelationship, the in/out adjustment also raises and lowers the sucker, but in a non-linear, not-easily predictable way. For example, the operator may desire to screw in the pins to attain a more-aggressive singulation. Screwing the pins in raises the stack. They are then faced with two possible sucker adjustments to raise the sucker to follow the stack. They may inadvertently choose the incorrect tilt adjustment (which both raises and tilts the sucker, and unbalances the feeding) rather than the correct up/down adjustment.

In the prior art, to help with the reduction of feeding multiple sheets, the inserter manufactures provide an adjustable hopper floor plate, referred to as a T-plate. That is movable to increase or decrease the opening 174 size, depending upon how stiff or flexible the sheets are. Its purpose is to increase the stiffness of the sheet being peeled down by the sucker. This increases the deflecting force and helps prevent the sucker from dragging more than one sheet down at a time.

There are also several significant disadvantages to the above-described T-plate arrangement. It is difficult for an operator to know how to adjust the location of the plate forwardly or rearwardly, and it is highly dependent on the particular characteristics of a type (or even batch) of sheet material. The base of the "T" also provides a frictional component that impedes subsequent plucking of the sheet. Notably, the base of the "T" contains a ridge 173 on the trailing side next to the back guide 160 that, due to the weight of the stack on the lowest sheet, can emboss (e.g. indent) the sheets in the stack. The recent use of non-stick coating has not effectively alleviated the friction problem. It has been recognized that the friction is chiefly caused by the embossing on the T-plate ridge. The resulting embossed edge can make it very hard to pluck the sheet from under the weight of the sheets in the hopper. This embossing produces frictional sliding forces far greater than would be predicted by hopper weight and coefficient of friction calculations.

Excessive plucker sliding forces can scratch or scuff the sheets. Excessive sliding forces can also cause a sheet misfeed as the plucker tears the sheet's edge off, rather than drawing the sheet fully from the stack.

The sucker peels the sheet down towards two metal lips or shelves 250 (FIG. 6). When the sucker peels the sheet down, a finger 212 withdraws and returns to hold the edge of the sheet in the singulated state against the shelves. The shelves are provided for registering the sheets, and their angle is adjustable by plastically deforming (bending) the metal. This angular bending compensates for several other misadjustments, and the shelves, hence, assist in singulating the sheets as the sucker pulls each of the sheets between the shelves.

There is a particular disadvantage to the prior art shelves. Since the edges of the shelves are parallel, sheets of a certain stiffness can become lodged or wedged within the shelves' parallel gape—effectively bowed and pinched between the two inner edges of the shelves. This is particularly troublesome because the gripping throat of the plucker's jaws is limited, and therefore the position in which the sheets are held becomes critical. The throat of the jaws is less than one-quarter inch when opened, and it will not pluck successfully unless the material is held within that tolerance.

Finally, it has been recognized that, when the plucker attempts to pull the singulated sheets from the hopper, it has many forces to overcome. First, it must overpower the sliding friction forces produced by the coefficient of friction of the bottom sheet against the floor plate. Then the gripper must tug against forces caused by (a) fiber-lock between uncoated paper sheets, (b) static electricity forces that bind the sheets together, (c) adhesion due to surface tension, and (d) ink or adhesive between adjacent sheets that has oozed and/or dried. Sheets may also contain secondary sheets such as refrigerator magnets, medallions or small parts that must be slid from under the weight of a hopper full of these sheets. There is no present method for reducing or overcoming these various resistance forces between the bottom sheet and the adjacent sheet(s) in the stack.

There have been various prior attempts to address inserter feed hopper and feed mechanism unreliability problem. There are several Bell & Howell patents suggesting solutions, such as U.S. Pat. Nos. 3,844,551, 3,965,644, 4,411,416, 4,013,283. However, at this date, Bell & Howell and their competitors still offer a hopper design that has remained essentially unchanged for decades.

SUMMARY OF THE INVENTION

This invention overcomes various disadvantages of the prior art by providing an improved hopper and singulating/ feed assembly for a utilization device, such as an inserter, that feeds sheet-like materials from a hopper feed stack that reduces the various geometrical and physical problems that lead to jams, misfeeds and failures to properly singulate the stack. Notably, a hopper that reduces the pressure on the bottom sheets of the stack by providing a parallel wedge structure at the stack base is provided. This wedge structure also helps to drive bottom sheets successively forward toward a front face so as to further break frictional and adhesive contact between sheets at the bottom of the stack. Hopper side guides are provided with integral angled shelves that engage front side edges of the stack and allow easier singulation of respective bottom sheets. Likewise a fixed sucker block assembly is provided, which seats a suction cup in a rotating base with a surrounding planar block face and an integral fulcrum edge for improving the separation of the bottom sheet from the overlying stack. The block face is adjusted to lift the stack upon engagement for further aid in singulation. This block is also fixed in rotation and vertical position with respect to the stack, requiring no continual adjustment. There are also lower shelves upon which the sheet is driven as the sucker rotates away from the stack that have non-parallel sides to avoid binding, and more accurately locate the sheets for subsequent draw into a raceway by a gripper/plucker assembly. A central roller is provided between the front face of the hopper bottom and the rear guide so as to reduce friction during draw of a sheet forwardly. The parallel wedge, structure, likewise, can include a rear angled edge with short (forward-extension) base for supporting the rear of the bottom sheet of the stack that reduces friction. Overall, the of support area for the bottom of the stack (front shelves, rear shelf and roller) is minimized while still maintaining sheets in a positively supported orientation until drawn by the sucker.

According to further embodiments, the sucker block can includes a valve for varying the vacuum flow passing through the suction cup. The block can include a front edge that supplies a variable airflow to the stack to balance the suction force and assist in breaking up the sheets for better singulation. The block can be centered or offset with respect to the stack. Alternatively, a plurality of side-by-side blocks can be used on the stack. The blocks can be arranged to engage the stack at time-separated intervals by for example, varying their length and/or rotational positioning on a common rotating shaft. The shaft can be driven at a variable rotational rate so that respective bottom sheets are initially drawn from the stack at a slower rate by the sucker than the subsequent rate of rotation/draw into a final position to be pulled away by a plucker assembly (at a point resting on the non-parallel shelves). The hopper can be provided with anti-static bars to reduce attraction between sheets. Likewise, a variety of air sources/air knives can be used to selectively direct break-up air at the stack at various times. The hopper's angled rear edge can be the lower part of an adjustable rear guide that is sized shorter than the length of the sheets to induce a small trough-shape (via gravitational droop) to further stiffen the respective bottom sheets as they are drawn from the stack.

BRIEF DESCRIPTION OF THE DRAWINGS

The foregoing and other objects and advantages of this invention will become clear with reference to the following detailed description as illustrated by the drawings, in which:

FIGS. 9–12 are respective plan, front, side and perspective views of a sucker block according to an illustrative embodiment of this invention;

DETAILED DESCRIPTION OF AN ILLUSTRATIVE EMBODIMENT

Figure 1:
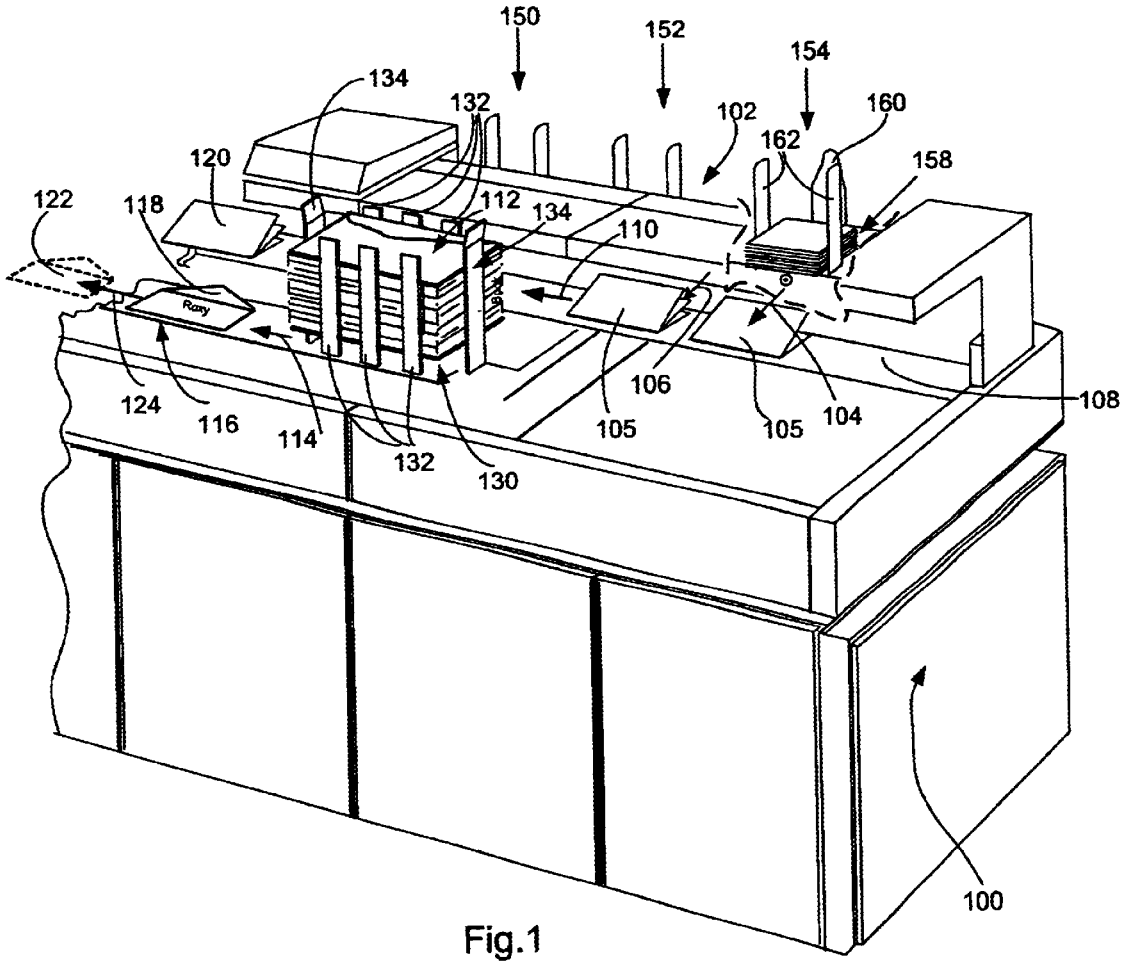
Fig.1 (Prior Art)
FIG. 1, already described, is a perspective view of an exemplary inserter including an envelope feed station and a series of contents feed hoppers according to the prior art.
Figure 2:
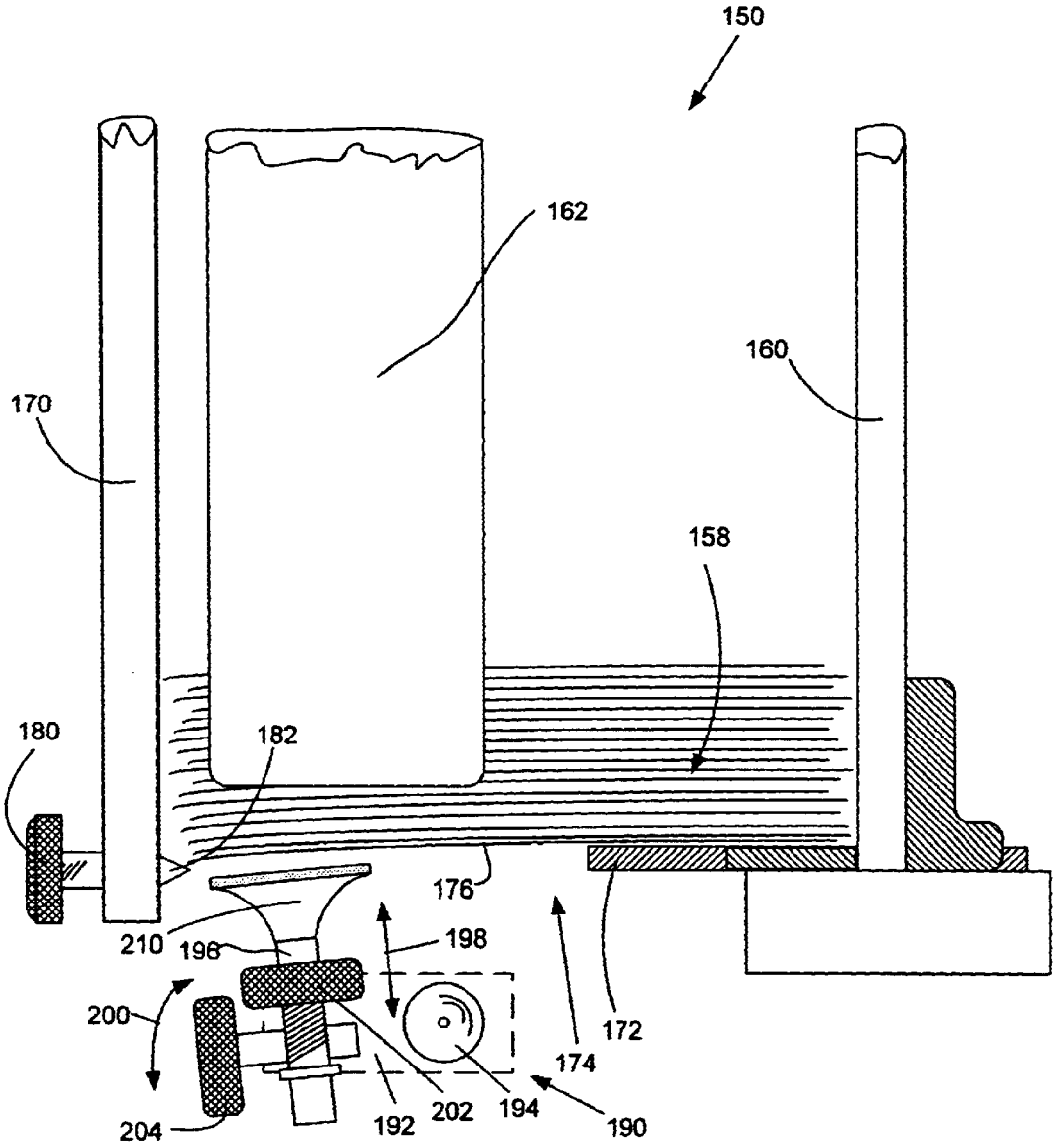
Fig. 2 (Prior Art)
FIG. 2, already described, is a partial side cross section of an exemplary contents feed hopper for the inserter of FIG. 1 shown prior to withdrawal of a bottom sheet from the feed stack.
Figure 3:
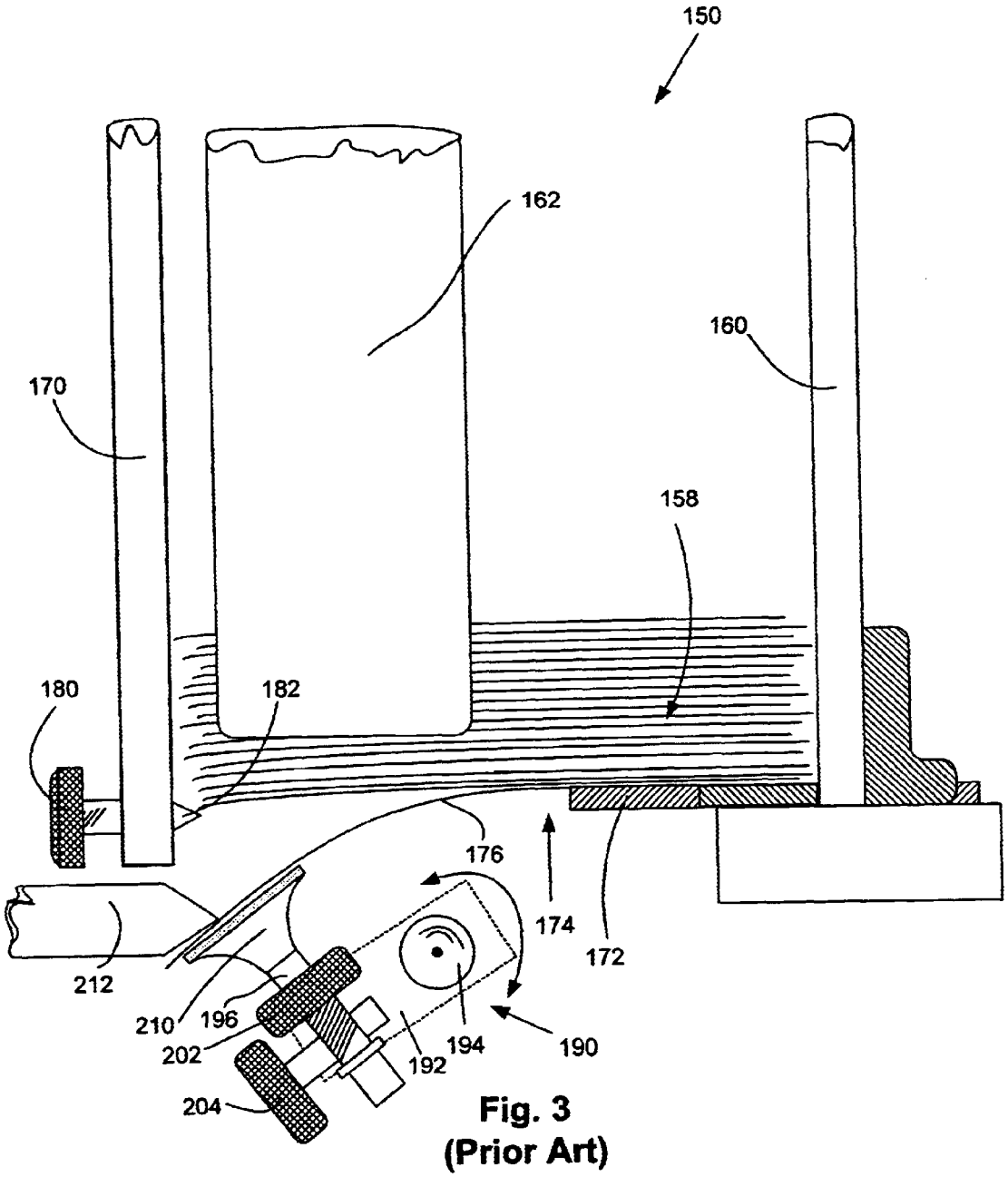
Fig. 3 (Prior Art)
FIG. 3, already described, is a partial side cross section of an exemplary contents feed hopper for the inserter of FIG. 1 shown during withdrawal of a bottom sheet from the feed stack.
Figure 4:
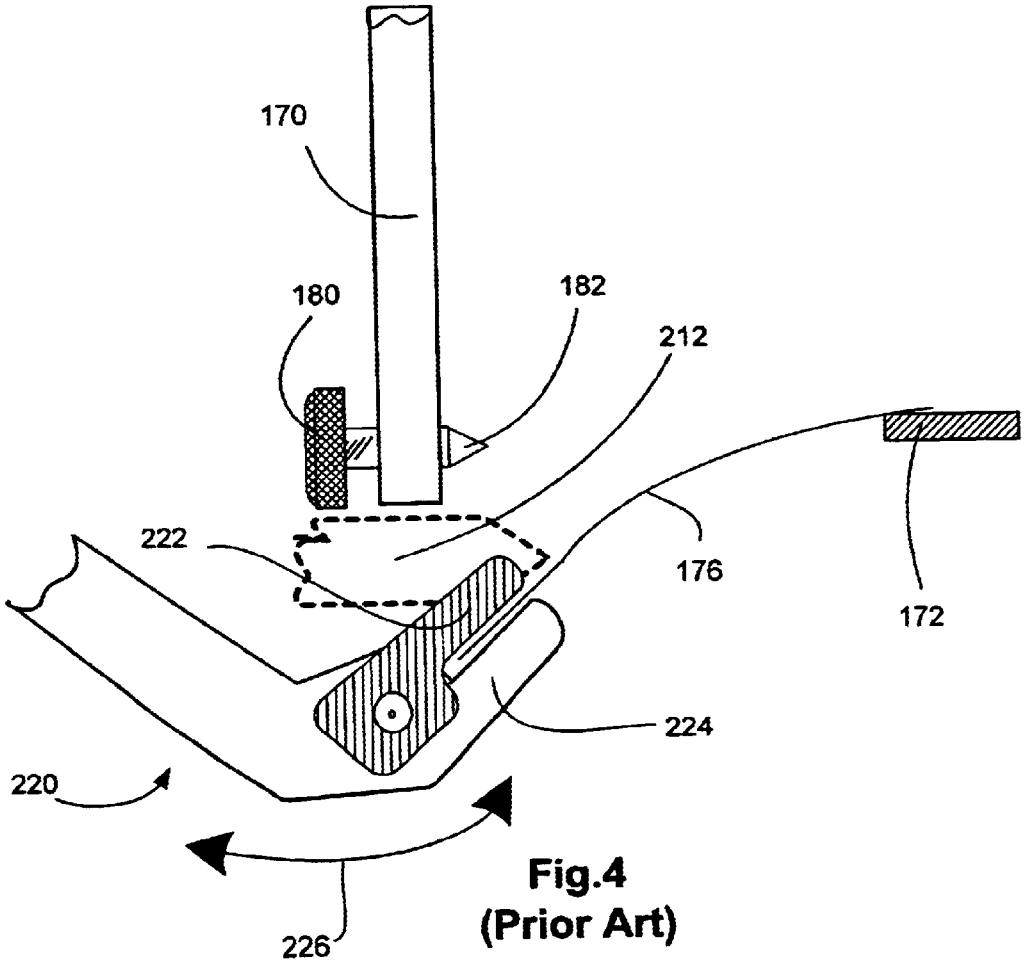
Fig.4 (Prior Art)
FIG. 4, already described, is a partial side cross section of an exemplary contents feed hopper for the inserter of FIG. 1 showing the gripper assembly withdrawing the sheet from the feed stack.
Figure 5:
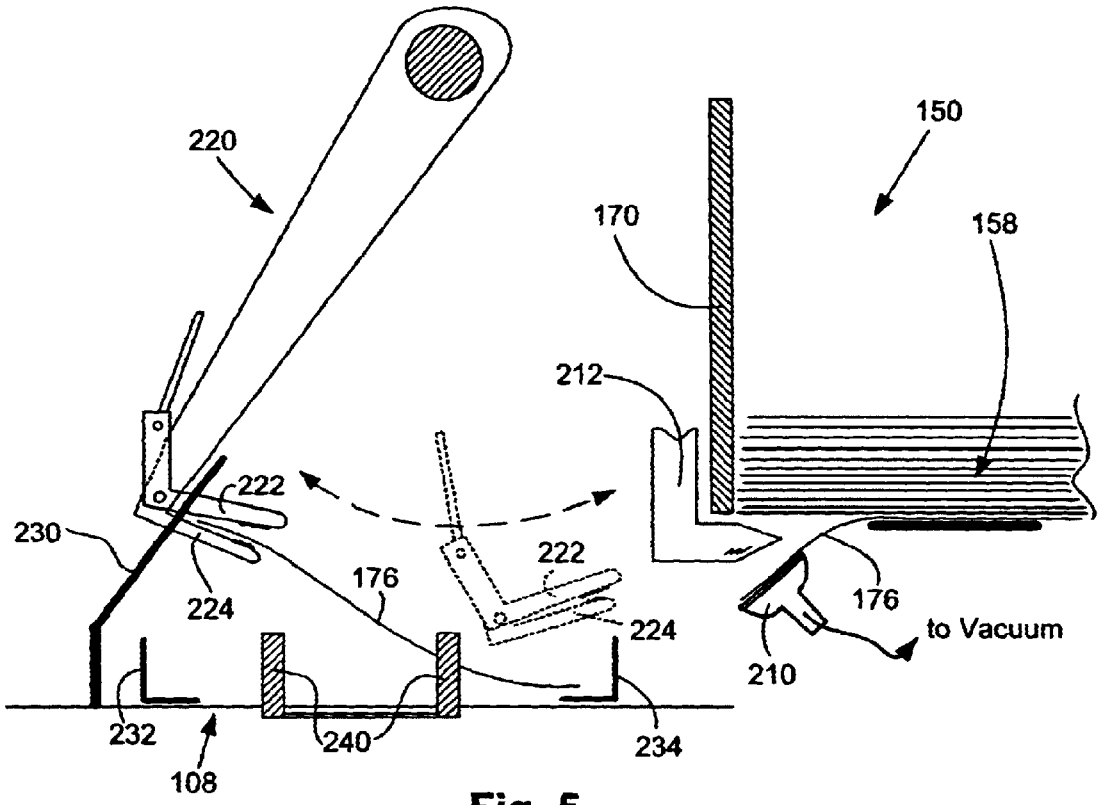
Fig. 5 (Prior Art)
FIG. 5, already described, is a partial side cross section of an exemplary contents feed hopper for the inserter of FIG. 1 showing the deposition of the sheet by the gripper assembly onto the inserter raceway.
Figure 6:
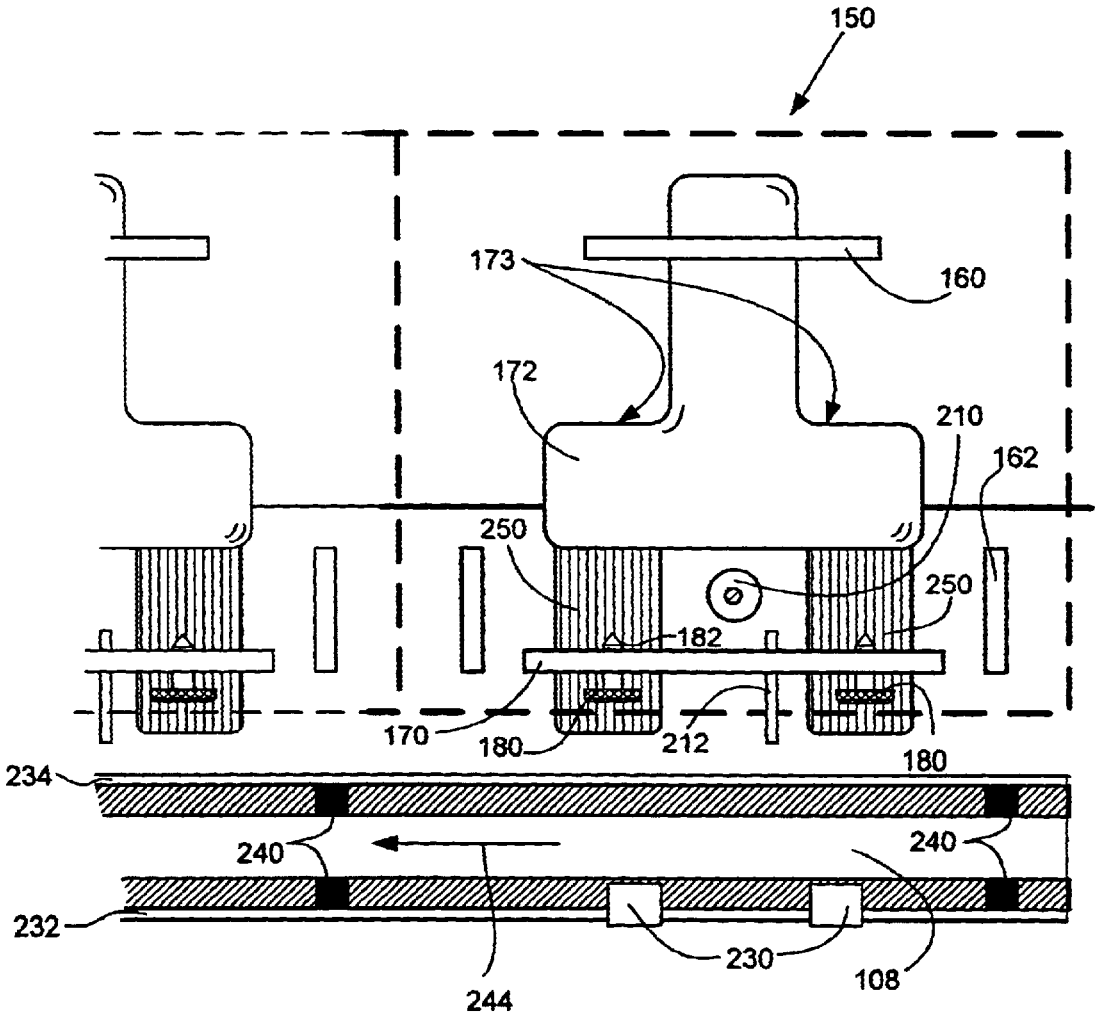
FIG. 6 (Prior Art)
FIG. 6, already described, is a partial plan view of the inserter of FIG. 1 detailing the hopper and raceway.
Figure 7:
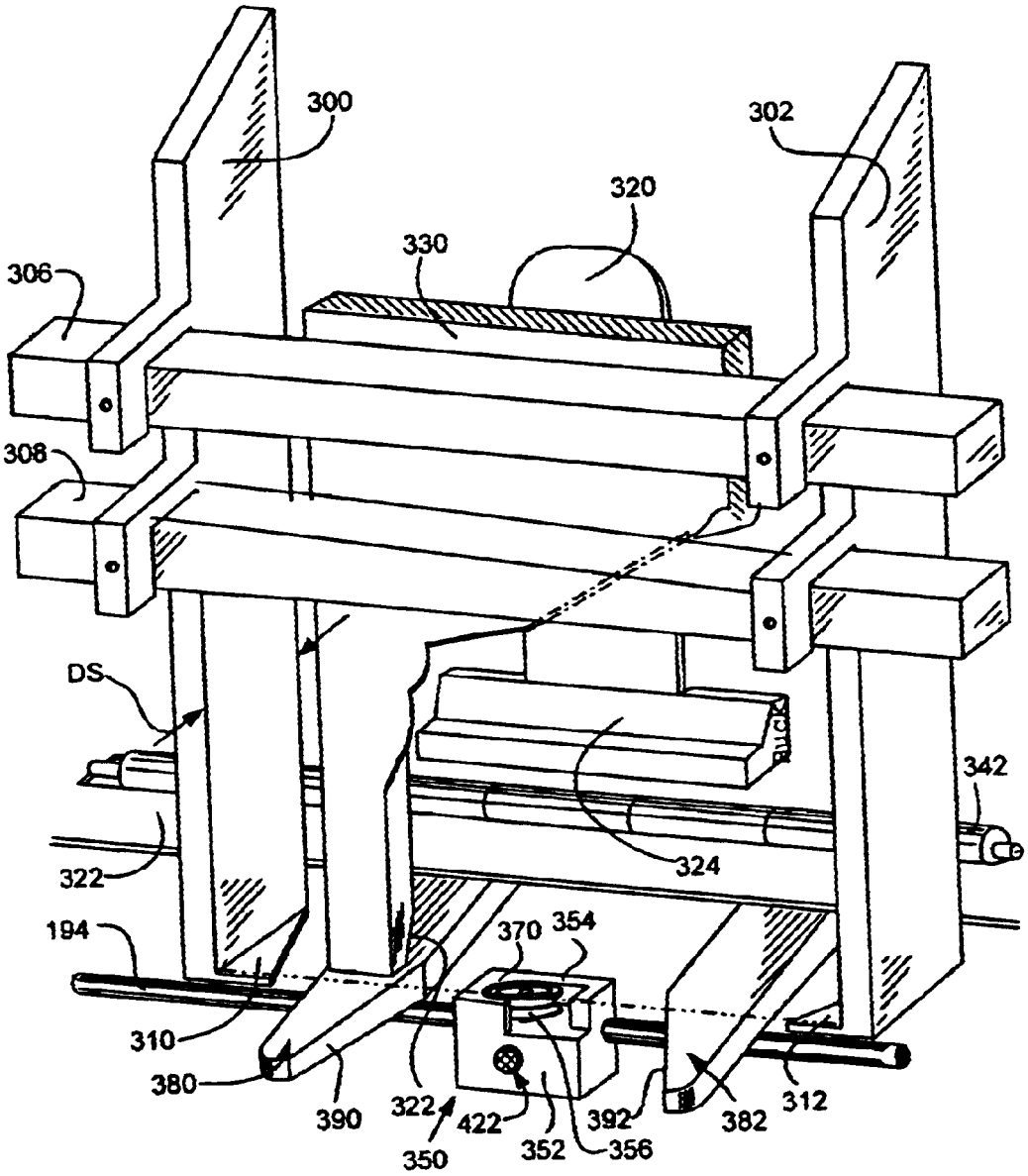
FIG. 7 is a cutaway perspective view of an improved hopper and contents feed mechanism according to an illustrative embodiment of this invention.
Figure 8:
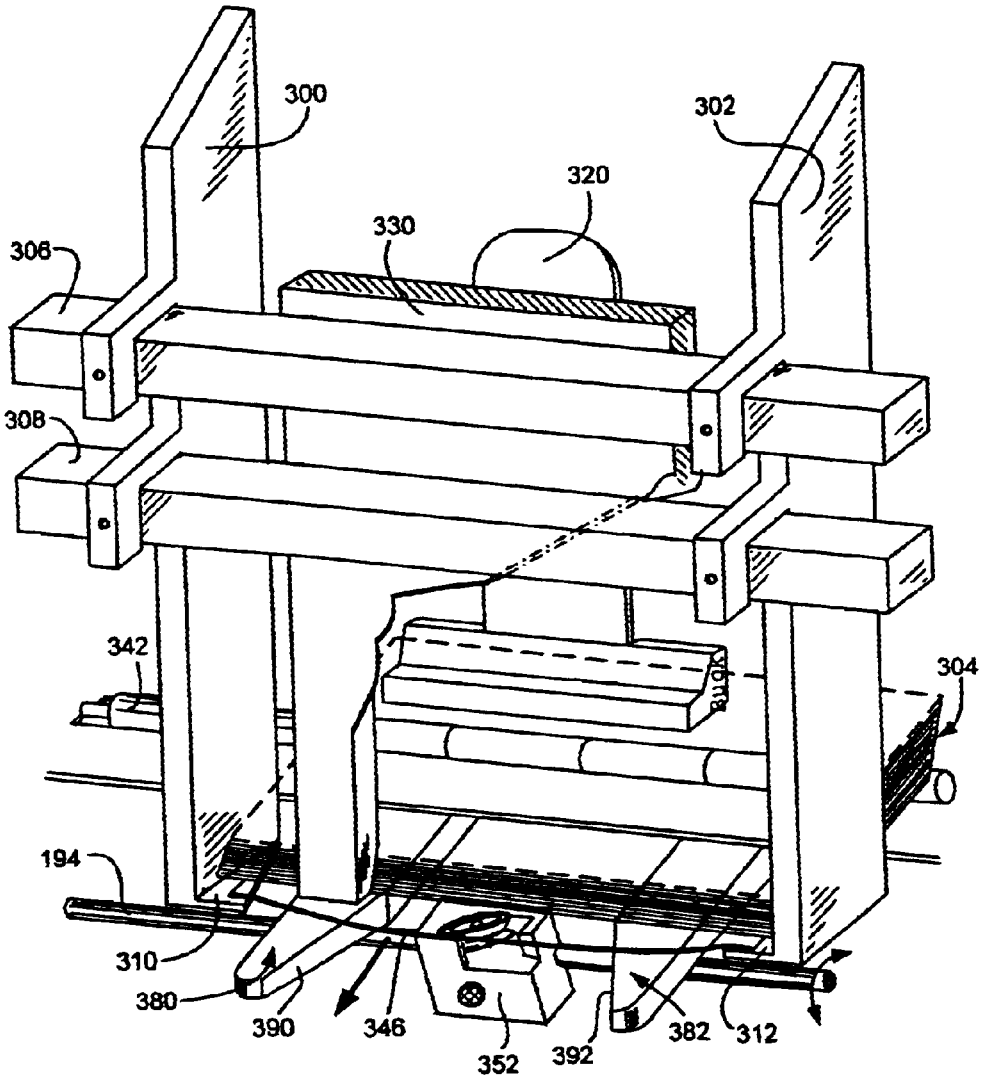
FIG. 8 is a cutaway perspective view of the improved hopper and contents feed mechanism of FIG. 7 showing a stack of contents sheets loaded thereinto.

FIGS. 7 and 8 show a contents feed hopper according to an illustrative embodiment of this invention. The feed hopper includes a pair of upright side guides 300 and 302 that engage the widthwise edges of the sheets in the stack 304 (see particularly FIG. 8). The side guides are adjustable along preexisting inserter rails 306 and 308 and can be locked in position using set screws or other locking devices as shown. The side guides 300 and 302 include integral shelves 310 and 312, respectively, at their lower ends. The shelves 310, 312 are angles, being narrowed towards the backstop so that the opposing shelf edges are not parallel. This prevents a stiff sheet from becoming undesirably wedged between the shelves 310, 312, and hence jammed.

More particularly, the shelves 310, 312 advantageously enable sheets to be supported firmly in the stack, but easily drawn away based upon the mechanical advantage that is derived from the catenary action of a flexible member. This catenary action is attained based upon the normal forces applied by the sucker that become translated into inwardly directed lateral forces at the shelves. This is shown for example in the draw of the bottom sheet 346 in FIG. 8 wherein a catenary is created adjacent the sucker assembly 350 causing the side edges to draw away from the outer edges of the stack 304. The geometry of the side lips is such that the edges of the bottom sheet are slipped as well as peeled. Both forces act solely on the lowest sheet. The next sheet has only sheet-to-sheet sliding forces, but in equal force amounts to the stationary third sheet above it and to the singulating first sheet below it. The combination of these forces help to produce reliable sheet singulation on the lowest sheet. When the lowest sheet 346 is drawn from the stack, it has to move only a short distance to clear the ledge and it is then further relieved of frictional forces.

The shelves 310, 312 are shown attached integrally to the side guides 300, 302 as a preferred attachment point. Advantageously, this automatically locates them at a fixed point with respect to the side guide, and hence the overall hopper geometry, thereby alleviating the necessity for a separate operator adjustment of the height of the shelves.

In an illustrative embodiment, the side guides 300, 302 have a depth DS of approximately ½ inch to 3 inches. The shelves 310, 312, at their frontmost ends, project inwardly in a range of between ⅛ inch to ½ inch. However, these ranges may be varied for different size, stiffness and types of materials according to alternate embodiments.

The hopper further includes a moveable back guide/backstop 320. In one embodiment, the back guide engages slots (not shown) in the base plate 322 of the inserter. It can be locked into a lateral position within the slots using an appropriate lock screw or other locking mechanism. Notably, the bottom edge of the base or back plate includes an angled bottom edge 324 (See FIG. 10). The bottom edge 324 is angled to direct the lower sheets in the stack forwardly toward the raceway 108 Pulling the sheets forward, while singulating, substantially eliminates the need for the sheets to be stacked evenly (e.g. edge-justified) in the hopper.

There is also provided an improved front wall 330 that forms the front stop for the stack closest to the raceway. The lower edge 332 of the front wall 330 is first straight, and then angled so that it is approximately parallel to only part of the angle surface defined in the lower edge 324 of the back guide 320. In this manner, the top group of sheets are supported by the wedge and the bottom group of sheets in the stack 304 are directed forwardly as they drop downwardly toward the bottom. The bottom edge of the back guide 320 also includes a horizontal shoulder or ledge 340. This raised shoulder supports the rear edge of the forwardly directed stack bottom. Approximately midway between the front wall 330 and the base plate 322 is a central support roller 342. The bottom sheet 346 of the stack directly engages this roller. In one embodiment, the roller 342 can rotate freely and includes a somewhat continuous surface constructed from an drawn from the stack 304.

Hopper floor components, such as the ramp 324, ledge 340 and rollers 342 are centrally located, do not span the entire width of the sheets and may leave the outside edges unsupported. This provides relief for fragile sheet edges to prevent snags in that area. Centrally located components also provide slight troughing of the sheets with the center being slightly higher than the edges. This increases beam strength to the sheets and helps overcome other bending or curl distortion in the sheets. This slight troughing or corrugation thus provides stiffness to aid the sheet to be slide out of the hopper. This physical concept is discussed further in U.S. Pat. No. 5,213,216 (RE 35,844), entitled PAPER GUIDING METHOD AND APPARATUS, by H. W. Crowley.

Figure 13:
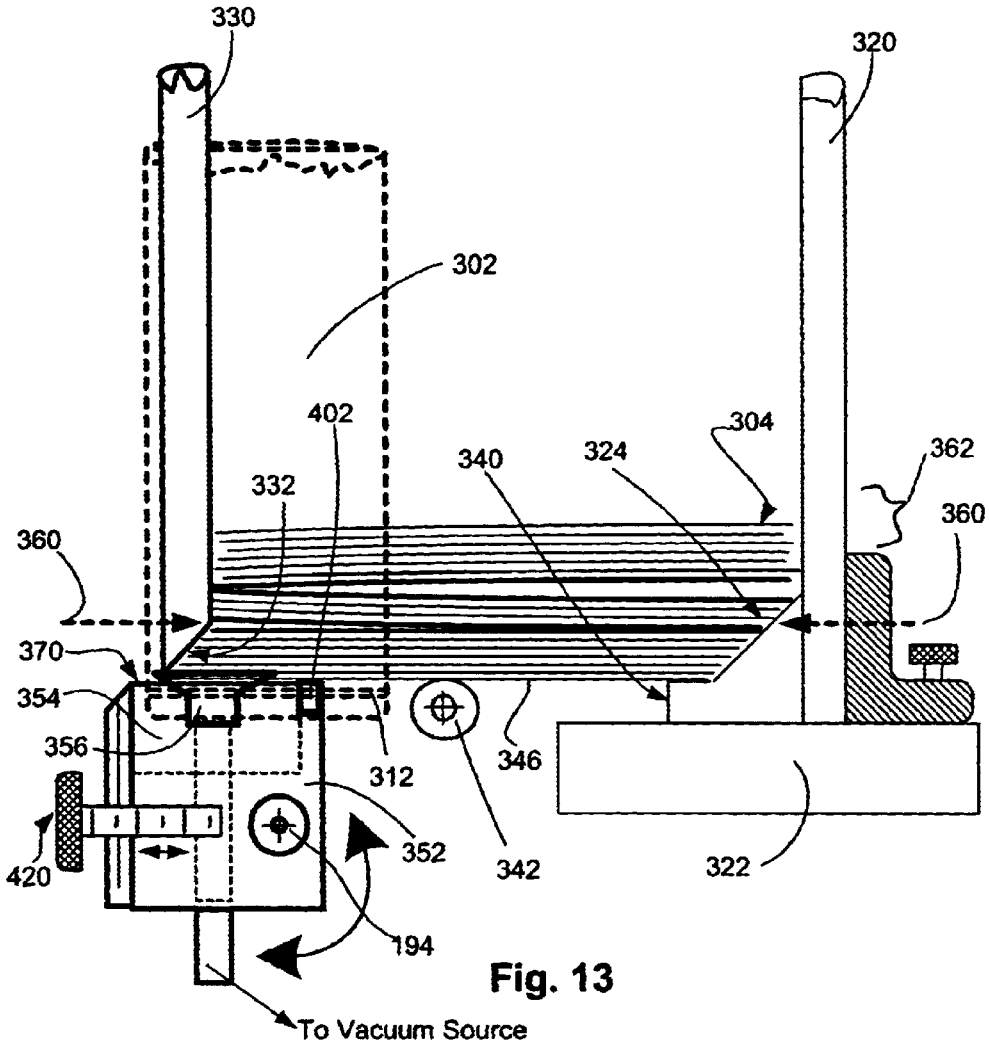
FIG. 13 is a partial side cross section of the improved hopper and sucker block shown about to withdraw a bottom sheet from the stack.
Figure 14:
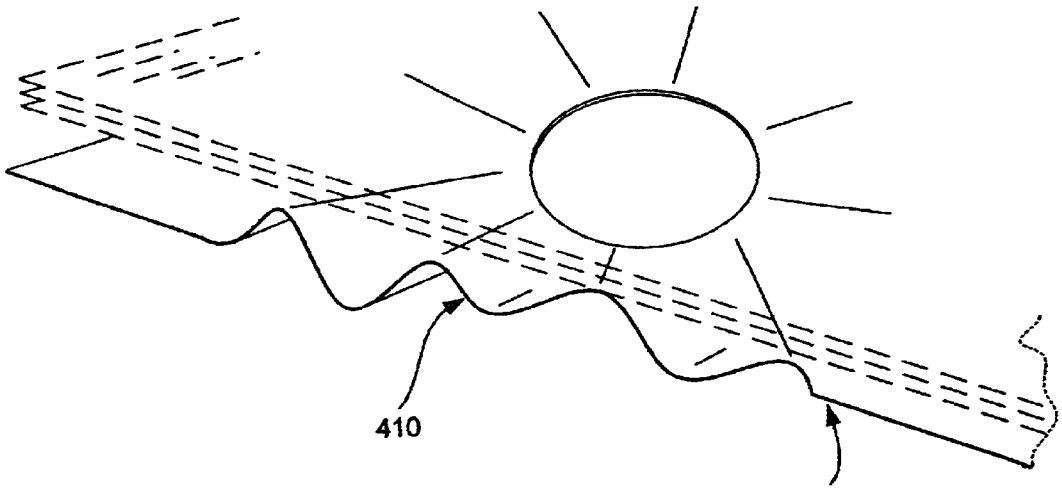
FIG. 14 is a somewhat schematic perspective view of the draw effect on a bottom sheet with respect to the stack.

FIGS. 9–12 show an improved sucker assembly 350 according to an illustrative embodiment of this invention. The sucker assembly will be described further below. Briefly, it comprises a base block 352 defining a cavity 354 into which is seated a sucker suction-cup 356 constructed from an appropriate elastomeric material. In one embodiment, the depth of the suction cup cavity 354 is in a range of between ¼ to ½ inch. The block is fixedly mounted to, and rotates with the common shaft 194 described above along a radially spaced swing-arm movement path (see generally the swing arm 371 of FIG. 17). It is interconnected with a vacuum force as shown in FIG. 13, and thereby provides draw force for removing the bottom sheet 346 from the stack adjacent to the front wall 330. Before describing further the sucker block assembly 350, the geometry of the hopper as it relates particularly to the operation of the sucker is now described in further detail.

The angled rear edge 324 of the back guide 320 causes the sheet material to be subject to deflecting forces. Thus, if the sheet material is warped or curled, then the effect of these deflecting forces causes all the material to conform to a known geometry. This counteracts most unpredictable sheet geometry, since bending material in one axis generally removes the bend in any other possible axis. Accordingly, the resulting, predictable sheet geometry overcomes many sources of poor singulating performance.

Significantly, the angled rear edge 324 extends upwardly higher than the angled front edge 332 of the front wall 330. A plane 360 taken through the corner of the angled front edge 332 passes beneath the apex of the angled rear edge. The difference 362 defines a region in which the stack becomes constricted above the region in which the front and rear edges 332, 324 are essentially parallel. This constriction, in essence, creates a support beam within a certain number of sheets residing in the constricted region that relieves pressure on the lower sheets (which are unconstricted due to the parallel front and rear edges). According to the geometry produced, the lowest sheets are relatively small in number and are not largely effected by the weight of the overlying stack. Rather, this weight is supported by the constricted sheets. As sheets exit the lower portion of the stack through action of the sucker and plucker (shown, for example in FIGS. 2–5), further constricted sheets pass below the plane 360 and become part of the free stack. It should be noted that prior attempts to increase stack size have heretofore only served to increase weight on the lowest sheets in the stack. The present technique alleviates the effects of increased stack weight on the bottom sheets by providing, in essence, a secondary base above the lowest sheets in the stack. As such, the size of the stack (and its associated weight) can be increased substantially without negative effects.

In addition, the use of a pair of forwardly angled parallel edges, combined with a reduction in pressure on the lower portion of the stack, allows gravity to urge each successively lower sheet further forward to aide in justifying the sheets against the desired front edge location. Clearly, the reduction in force between sheets in the lower portion of the stack reduces a variety of negative influences on the sheets such as fiber lock, frictional engagement, electrostatic attraction and adhesive effects of glues and inks. In fact, the urging of successive sheets more forwardly by the angled surfaces aides in breaking adhesive and other effects—where they might otherwise remain unbroken before singulation according to prior art techniques.

The ledge or shoulder 340 also provides a region that is relatively small and, that when the sheet is withdrawn by the plucker, causes it to reside in an open cavity free of any influence from the next adjacent sheet in the stack. Additionally, the roller 342 acts to substantially reduce friction applied to the bottom sheet 346, while providing a contact point that enables the sheet to apply a measured frictional force to the adjacent sheet the reabove so as to assist in drawing that next sheet forwardly as desired. Note that this force acts in a relatively small region of the next sheet, thereby avoiding several of the negative influences brought about by fiber lock and other influences involving large areas of confronting contact between adjacent sheets.

Figure 16:
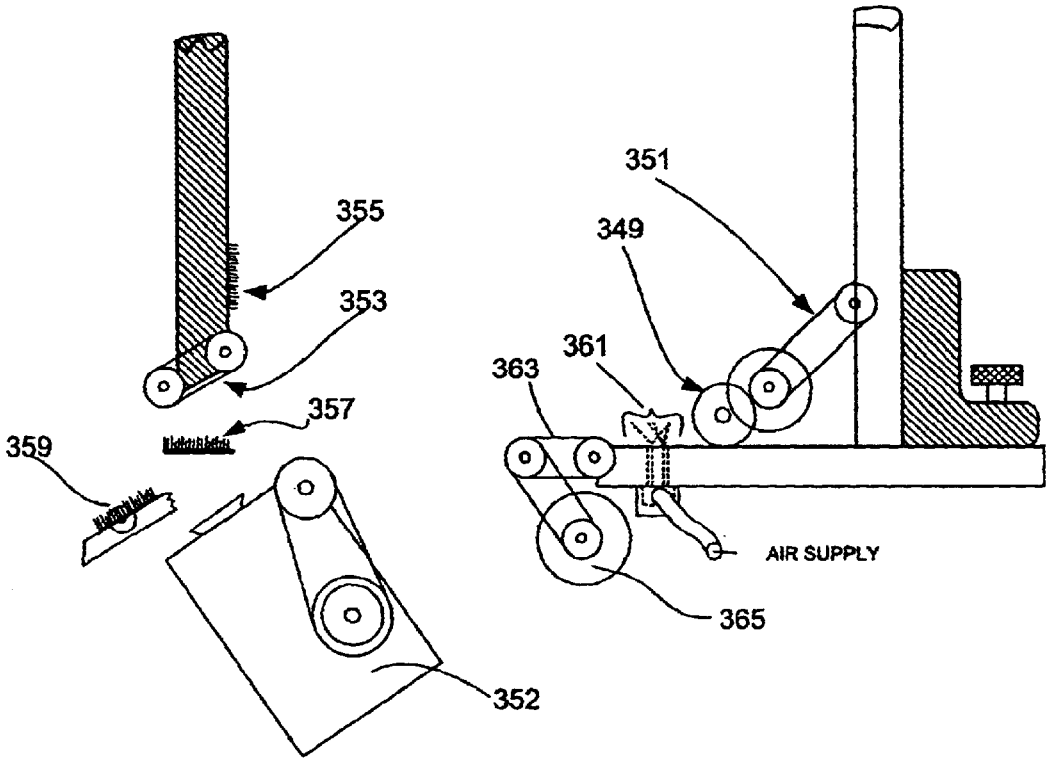
FIG. 16 is a side cross section of the hopper according to an alternate embodiment detailing various feed improvements.

With reference to exemplary FIG. 16, according to alternate embodiments, the rear ledge or shoulder 349 can define a partial or complete moving surface to further reduce friction on the bottom sheet. Additionally, the angled rear edge 351 and front edge 353 can be passive or active revolving rollers or belts as shown. There can also be brushes 355, 357 and 359 provided at various locations to aid in reducing friction by enabling increased sliding of sheets. Likewise air-bearings 361 and/or belts 363 (driven by a motor 365 as shown or undriven, freewheeling units) can be provided to further reduce local friction and aid singulation. The motors can be driven on a timed cycle based upon draw of sheets, or can be provided with slip clutches (not shown) that maintain a constant forward an/or downward force on the sheets that is maintained at a non-damaging level, but that generally urges the sheets in the desired direction. Other actuators, flat belts, brushes or circular surfaces that provide local reduction in friction and scuffing while still maintaining desired components of force directed generally forwardly can be provided alone or in combination according to these various embodiments.

In one illustrative embodiment the ledge or shoulder 340 extends outwardly between approximately ¼ and ⅛ inch. The height of the angled edge 324 from the shoulder to its apex is in a range of between ¼ to 1 inch. The height of the front edge 332 is approximately ¼ to ⅛ inch less than the height of the rear edge 324.

With further reference to the sucker assembly 350, the top face 370 defines generally a plane that, when the sucker is in its upmost position, is located above the upper faces of the side guide shelves 310 and 312. In this manner, the top face 370 periodically protrudes into the bottom of the stack, thereby compressing the front portion of the stack together. In one embodiment, the protrusion above the shelves 310, 312 can be in a range of approximately ⅛ inch to ¼ inch. Notably, the protrusion of the top face 370, to thereby cause compression of the front portion of the stack, creates an effect that homogenizes the sheet-to-sheet compression to make for a more predictable draw (peel-away) of the bottom sheet 346 from the remaining sheets. Similarly, the compression of sheets in the lower portion of the stack by the protrusion of the surface 370 assists in removing all air pockets between sheets. This reduces aerodynamic effects when one sheet is pulled rapidly away from another, thereby further ensuring that only the bottom sheet will be drawn by the sucker assembly. Explained differently, there is a lower breakaway force between the bottom sheet and the next (second) sheet than is generated between the second sheet and a third adjacent sheet further upwardly in the stack. The breakaway force between the second and the third sheets results, in part, from a vacuum along a large portion of the surface area therebetween.

Figure 17:
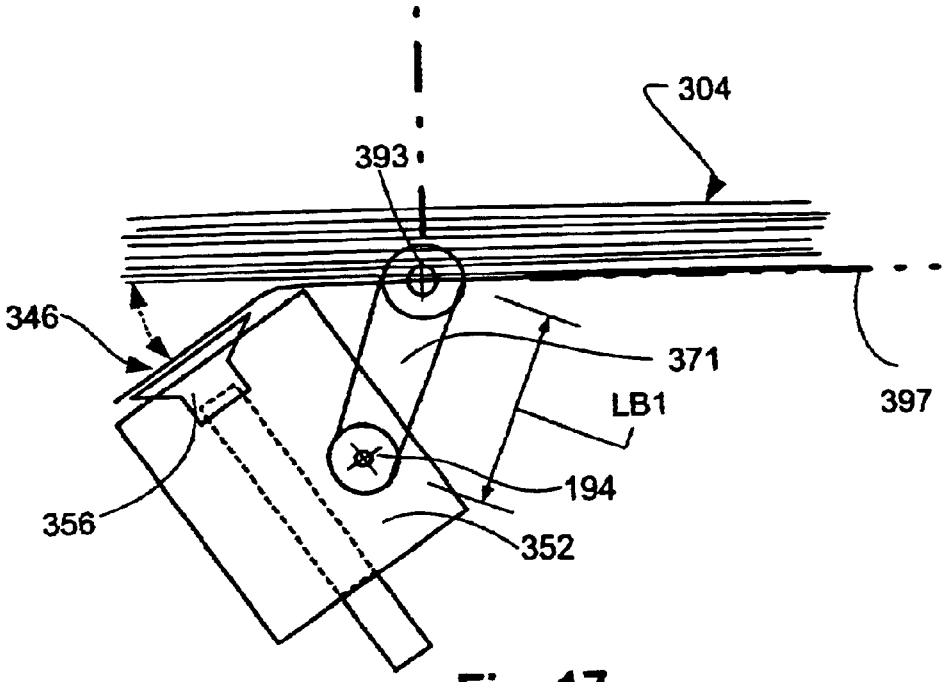
FIG. 17 is a schematic side view of a sucker block assembly mounted on a conventional pivot point and lever arm arrangement according to an embodiment of this invention.
Figure 18:
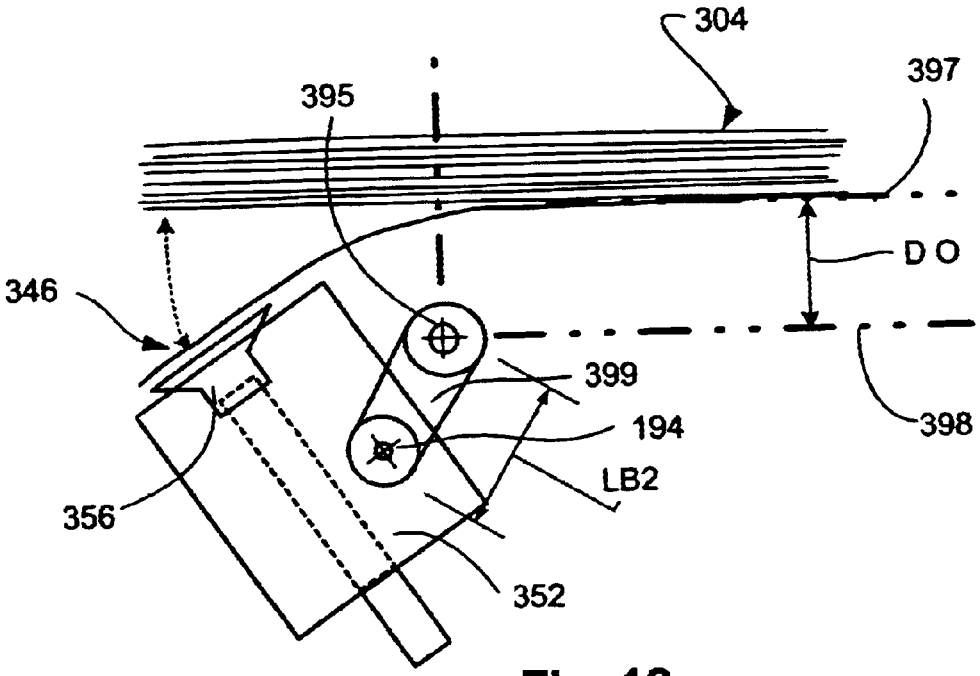
FIG. 18 is a schematic side view of a sucker block assembly mounted on an improved pivot point and lever arm arrangement according to an alternate embodiment.

Referring to FIGS. 17 and 18, the conventional spacing LB1 (approximately 1½ inch) and positioning of the lever arm 371 for ration of the sucker block 352 is shown. The lever arm moves the common shaft 194 within an arc of a radius equivalent to the spacing between the shaft (194) center and the pivot point 393. The pivot point 393 is aligned approximately with the bottom of the stack 304 (dashed line 397). This position, while effective, can be further optimized in an illustrative embodiment as detailed in FIG. 18. The local sheet-to-sheet vacuum peeling forces are proportional to the amount of overlapping sheet-to-sheet area. Thus, by decreasing the peeling radius the sheet-to-sheet vacuum forces that tend to prevent singulation are reduced. Accordingly, the pivot point 395 (FIG. 18) is moved below the line 397 to a new line 398 by a distance DO of approximately ¼ inch. Similarly, the lever arm 399 is shortened to LB2 (approximately ¾ inch).

Figure 19:
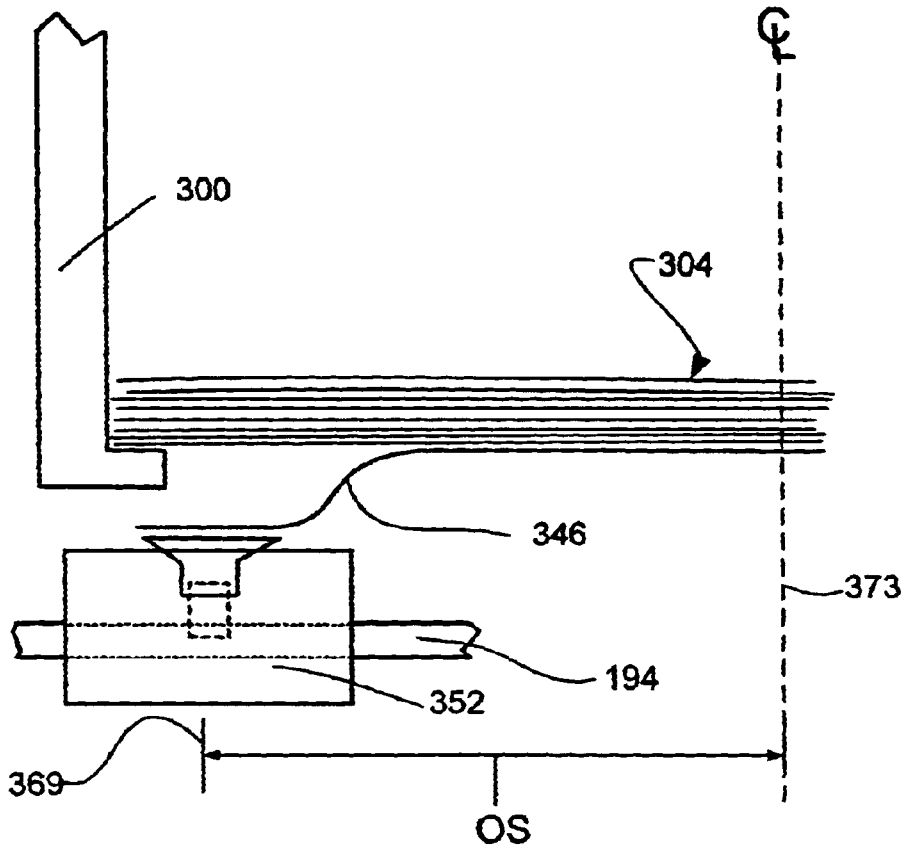
FIG. 19 is front cross section of an offset sucker block arrangement according to an alternate embodiment.

It has been recognized that, when a sheet is not peeled from the center, the peeling is over a smaller area than a centrally located sucker, thus reducing the vacuum forces which tend to peel more than one sheet at a time. Referring briefly to FIG. 19 the central axis 369 sucker block 352 has been offset by a distance OS on the shaft 194 from the centerline 373.

Figure 20:
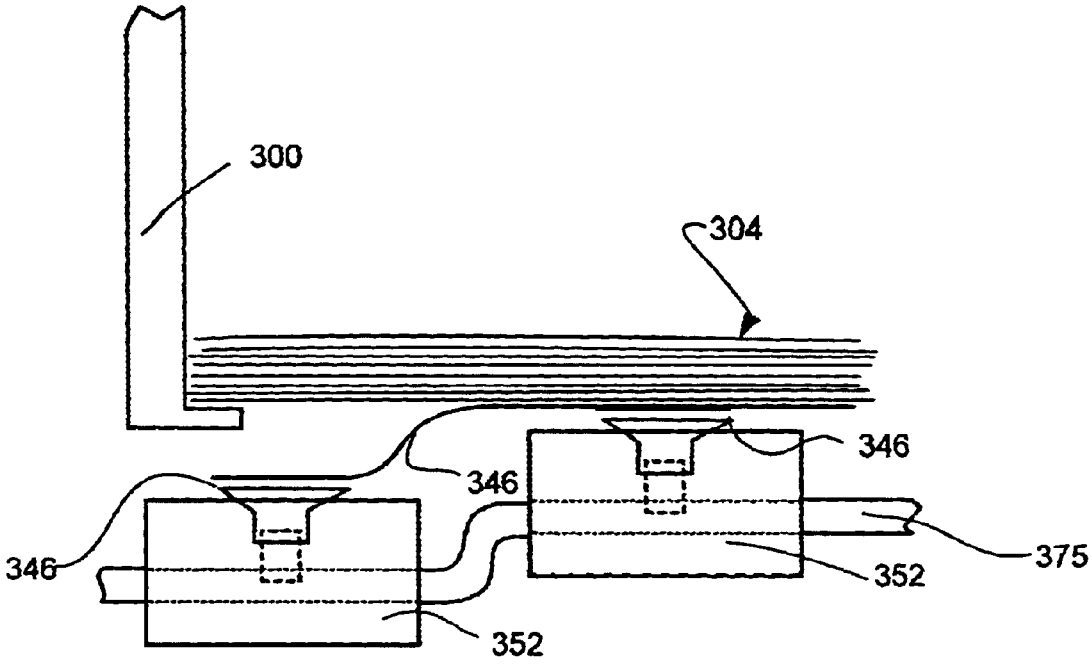
FIG. 20 is a front cross section of a multiple sucker block arrangement according to an alternate embodiment.

Similarly, as detailed in FIG. 20, a plurality of sucker blocks 352 (or other blocks without suction cups per se) can be mounted at one or more positions around the bottom the sheet perimeter. In this embodiment, the blocks are mounted s that their faces are at differing heights with respect to the sheet bottom. This is accomplished by using like-sized blocks 352 on a doglegged shaft 375. Conversely the sizes or configurations of the blocks themselves can be varied to locate the faces 370 at differing desired heights. The result of this configuration is that the faces 370 engage the bottom sheet at different times in the cycle, and in differing degrees of protrusion. Hence, a further sheet separating/singulating component is introduced. This arrangement advantageously enables the overall vacuum force to be reduced, which serves to reduce the chances of sheet damage and draw of adjacent sheets in the overlying stack.

Referring to FIGS. 7 and 8, another pair of shelves 380 and 382 are provided in-board of the side guide shelves 310 and 312, respectively. These shelves are mounted with respect to the lower surface of the base plate 322. They extend, generally beyond the front wall 330 into the region of the raceway. The bottom sheet from the sucker force and also to provide a backstop at which location the plucker (described in FIGS. 2–5) can reliably expect the front edge to reside. As shown in FIG. 7, the shelves 380 and 382 include front edges 390 and 392 that face eachother but are non-parallel. In other words, in this embodiment they angle outwardly in a forward direction with respect to eachother forming a widening opening in this direction. The use of directly opposing, parallel shelves may tend to bind the sheets in a wedged orientation so that it does not spring back after sucker pressure is removed. By using non-parallel opposing edges a directly opposing force along the full length of the sheet is not generated, thereby preventing the undesirable binding effect.

The geometry of the sucker assembly 350 is now described in further detail, with reference to FIGS. 9–12. As described generally above, the top surface 370 of the block includes a cavity 354 into which is mounted a suction cup 356. The suction cup is of somewhat conventional design, appearing as a flexible bellows-style cup in this arrangement. However, it can also be defined as another acceptable shape like the continuously curved dome shape shown in alternate embodiments herein. The cup is mounted on a tubular stem 400 that is interconnected with the vacuum source (not shown). The vacuum source in the exemplary inserter is a switched-constant vacuum force source generated by a vacuum pump (not shown).

The suction cup 356 is mounted so its top edge is slightly above the plane of the top surface 370 (for, example 1/16–1/8 inch above). This assures that it will always come into contact with the bottom sheet when the top surface flexibly engages the stack. As such, no particular adjustments of the height of the vacuum block or its suction cup are needed.

Figure 21:
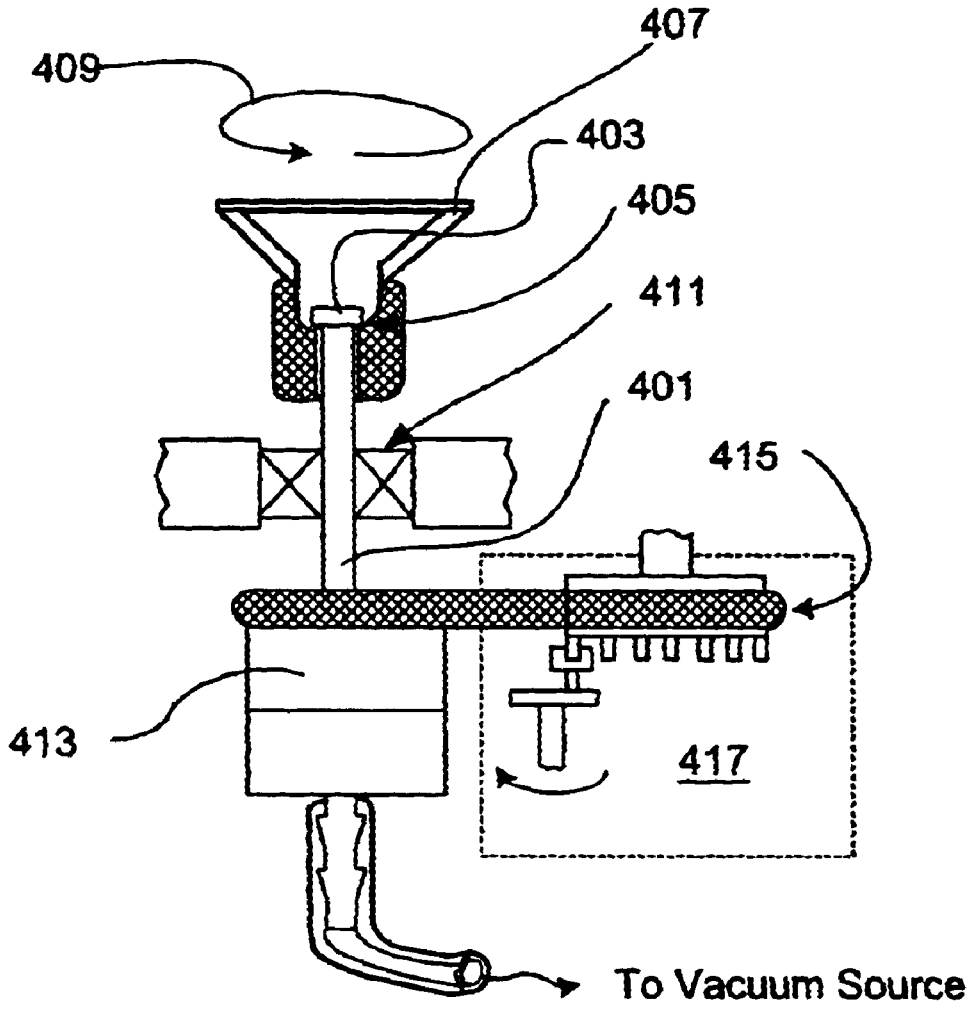
FIG. 21 is a schematic partial cross section of a rotational sucker block suction cup according to an embodiment of this invention.

Without controlling the mount location on the vacuum stem 401, the height of the suction cup 407 within the sucker block may difficult to regulate, and may tend to slip. According to an illustrative embodiment detailed further in FIG. 21, the vacuum stem 401 has a lip 403 that flexibly snaps over a conforming internal ridge or shoulder 405 within the base area of the suction cup. The lip 403 gives the operator a positive indication that the suction cup 407 has been seated to a repeatable, known height with respect to the sucker block and its associated movement path. The stem lip 403 also prevents the suction cup 407 from slowly sliding off its tube 401 due to the continuous pulling forces of singulation.

In addition, the suction cup 407 can be mounted so as to rotate slowly (curved arrow 409) to provide a more-even wear pattern to the lip of the cup, thus extending cup life significantly over prior implementations. In this example, the stem 401 is mounted within the sucker block on a bearing 411. The stem 401 is connected to a rotary union 413 that enable a vacuum lead to remain stationary and sealed, but allows the communicating stem to rotate by way of a drive belt 415. The belt is indexed for a predetermined rotational distance by an indexer mechanism 417. Any acceptable mechanical or electromechanical indexing mechanism (using gears, pawls ratchets, stepper motors, etc.) can be employed. In one embodiment, the indexing occurs each time a cycle of the sucker assembly completes The sucker block's top face 370 has an overall surface area that is sufficient to enable the stack to become compressed as described above. In one embodiment, the top surface defines ¼–1 inch walls (broken in places) around the central cavity 354. However, this geometry is highly variable. The sucker block's peeling motion produces an oscillation to bring only one sheet at a time into the plucker position. This up-down oscillation motion serves to lift and retract the stack in the forward area of the stack. This action breaks several types of sheet-to-sheet adhesion forces. For example, the up-down, oscillating peeling action of the sucker block vibrates the stack and loosens the sheets with respect to one another. Further, the rapid draw of the lower sheet, and the simultaneous lowering of the stack, creates a brief but important weight reduced interaction between the stack and the sheet undergoing singulation.

Figure 15:
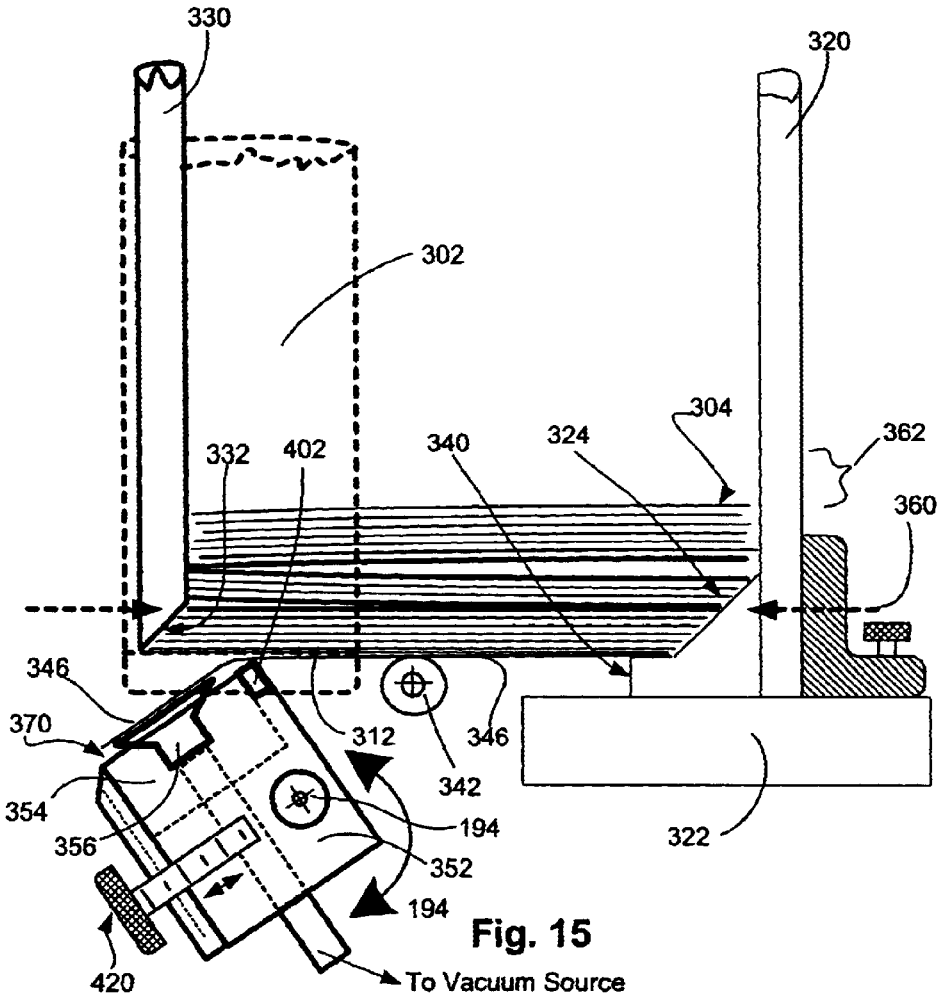
FIG. 15 is a partial side cross section of the improved hopper and sucker block shown about to withdraw a bottom sheet from the stack.

The rear edge 402 of the block's top face 370 acts as a fixed fulcrum when the bottom sheet is pulled off the stack. This is detailed generally in FIG. 15. A fulcrum provides desired rotational moment to the sheet, which further aides in singulation. According to the prior art inserter, the above-described T-shaped 172 floor plate is used, to provide such a fulcrum (generally along its forward edge). However, as noted above, adjustment of this plate forwardly and rearwardly is problematic. Porous and/or flimsy sheets are particularly troublesome in the prior art. Significantly, free-energy peel forces of thin/flimsy materials are not strong enough to resist the separation forces. Therefore, as one sheet is peeled down, others in the overlying stack often follow.

The rear edge 402 of the top face 370 can be coated with a high-friction surface to further assist pulling the sheet forward out of the stack. This edge 402 is preferably made of high-friction material, vacuum ports or knurled surface. Thus, when the sucker peels the edge of the sheet 346 down, this rear edge 402 offers a force multiplier, to give the sucker greater gripping strength, as a function of the amount of wrap angle around the rear edge. This is the appropriate action since the amount of force needed by the suction increases the more the sheet bends. In this invention, the force available to peel a sheet is the sucker force (f-sucker) times the effects of the coefficient of friction of the sucker ridge (f-ridge). The friction force of the sucker ridge increases as e (2.718) raised to the power of $\mu$, the coefficient of friction, times $\theta$, the wrap angle in radians. i.e.

$$f\text{-ridge}=f\text{-sucker}*e^{\hat{}(\mu*\theta)}.$$

Figure 22:
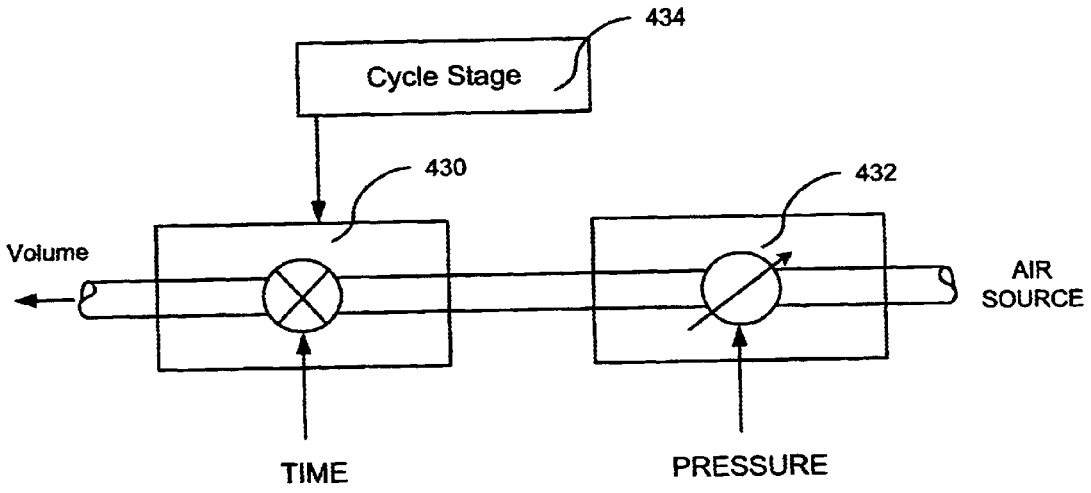
FIG. 22 is a block diagram of an airflow volume control arrangement according to an embodiment of this invention.

In one embodiment, the forward edge 404 of the block's top face 370 can comprise a source of compressed air having appropriate feed conduits (406 shown in phantom) interconnected with an optional air source (not shown). In an illustrative embodiment, the timing and amount of air pressure is controlled to be just appropriate volume for filling the vacuum created by the separating sheets. It has been recognized that using air to fill a vacuum caused by rapidly separating components (sheets) requires a carefully controlled volume to be introduced to the space created by the separation of the two or more sheets. By providing an air source at the front edge, this force is able to counterbalance the generated vacuum force, and thereby, fills the cavity to replace the vacuum force when needed with air atmospheric pressure to aide in the release of the sheet. Peeling of one sheet from another can only be accomplished when the vacuum between the sheets is dissipated. As further detailed in FIG. 22, the air source can be regulated on a time basis to match the needed air volume in a separation/singulation cycle. Accordingly, a timer 430 and pressure regulator 432 are provided in series with the air source so that a regulated amount of air volume is delivered depending upon the stage of the cycle. A cycle stage monitor/indicator 434 communicates with the timer. This can be an electromechanical monitor or a mechanical linkage operatively connected to the shaft 194 or its is associated drive components. For example, a geared valve can be connected to the shaft or an interconnected component. This air may also act a "air knife" to flutter and peel two sheets apart during initial singulation. This would be useful anywhere there is access to the edges of the stack. As discussed further below, this air source could also be mounted for example on the finger 212, surface 324, shoulder 340, edge 310 and/or the front angled lip 332.

The block's suction cup cavity 354 defines a broken shape along its front edge that creates a recess 408 enabling the finger 212 (described above with reference to FIGS. 2–5) to project thereinto. The depth of the cavity 354 should be sufficient for an appropriately sized finger to pass without interference. This recess 408 allows the sucker block 352 to pivot up within the overlapping edges of the finger. This further ensures the block cannot snag the material in the stack as it rotates. In an illustrative embodiment, the recess 408 for the finger 212 provides an additional source of wrinkles and peel separation forces. The finger remains stationary for the first few degrees of the sucker blocks 350 rotating peeling. This cause bending in the material, increasing the same wrinkling actions started by the sides of the sucker cavity 354.

Figure 23:
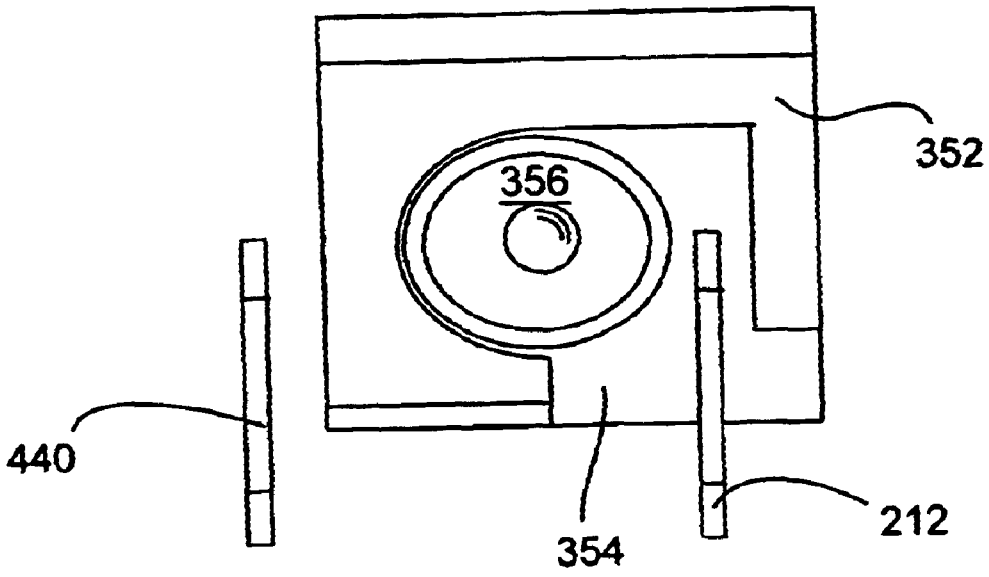
FIG. 23 is a top view of a sucker block having multiple hold-down fingers according to an alternate embodiment.

In one embodiment, detailed in FIG. 23, additional fingers (finger 440) are added with respect to the sucker block 352 to hold the sheet down symmetrically about each of the shelves. Additional fingers have been used in the prior art in specialized applications involving large sheets (typically 8½ inch by 11½ inch sheets or greater). Two or more fingers used on smaller sheets (generally 6 inch by 9 inch), according to this embodiment, ensures a flat, well-located placement of the sheet for the subsequent plucking action.

It is anticipated that the various functions of the sucker block could be accomplished with individual elements, and not necessarily combined into one block. Accordingly, more than one block could be used.

Again, sucker block force and peeling components 402, 404, 356, 354, 420 in additional embodiments could be composed of, or constructed with, elements such as various types of passive or active belts, rollers, air-bearings, geometry or brushes. These elements in conjunction with actuators or vibrators can be made to break the adhesion and peel the sheet away from the stack that is otherwise contained. One or more sucker force and peeling components could be place on the outside edges in concert with the side-guides.

The existence of the forward lip 404, extending from the suction cup 356 in connection with at least two other sides, provides an additional surface area that, in essence, attempts to create a wrinkling in the sheet 346 as shown generally by the wrinkled area 410. Wrinkling is produced in stiff sheets that are bent in two different angles in intersecting areas. The wrinkled sheet further enhances singulation and enables release of the bottom sheet from the remaining stack. This is most beneficial on very flexible or thin, permeable sheets, which are often the most problematic sheets to singulate.

In particularly, it has been recognized that thin sheets tend to feed in groups because they tend to easily closely conform to each other. Adjacent surfaces create a vacuum force when they are rapidly separated. The closer the surfaces reside, the more vacuum forces are created, tending to pull several sheets as one. It should be appreciated that in different embodiments, the foregoing vacuum dissipation may be likewise produced with any geometry that creates a gap or space between successive sheets.

Thin material is also often more permeable and thus the vacuum can attach together several adjacent sheets. The wrinkling 410 aids in solving both of these problems. The stresses caused by the wrinkles induce small bends that force the sheets apart. The bends also provide a channel that allows in atmospheric air to prevent a sheet-to-sheet vacuum from forming during singulation.

In one embodiment (particularly useful for porous sheets like cloth), the sucker block has a variable vacuum restrictor. The portion of the vacuum stem tube 400 passing through the sucker block 352 receives the distal end of a volume restrictor 420 that can be constructed in a variety of ways. In general, this embodiment employs a threaded turn screw 422 with a knurled knob that extends and retracts the distal (regulating) end 424 of the restrictor 420 with respect to the tube 400. This enables the airflow of the vacuum to be varied without changing the overall vacuum force (e.g. the prevailing vacuum level). As such, the flow of suction air acting upon the bottom sheet can be carefully controlled. This serves to prevent excessive vacuum airflow from passing undesirably through adjacent sheets via the bottom sheet's pores. Prior art designs reduce the vacuum for all hoppers at a central point. In some custom modifications, this approach has been replicated at each hopper individually. But it is not desirable to reduce the vacuum. Porous material can require even higher vacuum since it can be just as stiff, but some of the vacuum force is lost due to the sheets porosity. According to this invention, by restricting, rather than reducing the vacuum, the force can remain high, but the volume of vacuum flow is constrained so that it cannot effect subsequent sheets in the hopper.

As described briefly above, air sources can be used to aid singulation with respect to any hopper components that are adjacent to the edges of the lower portion of the stack.

Figure 24:
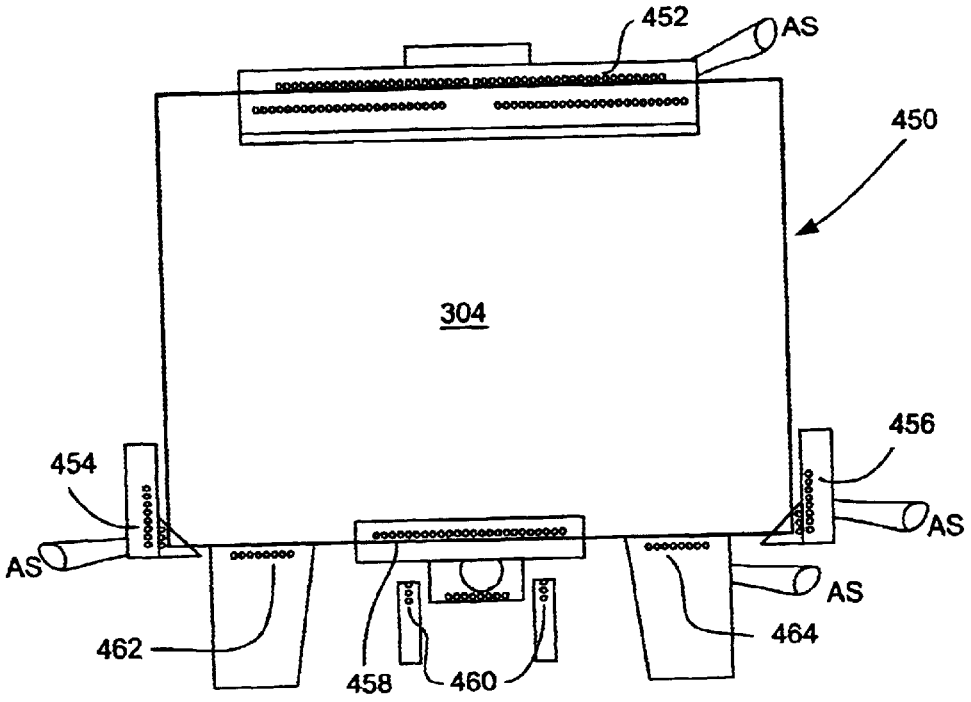
FIGS. 24 and 25 are respective top and side views, of an improved hopper detailing airflow and anti-static mechanisms according to an alternate embodiment.
Figure 25:
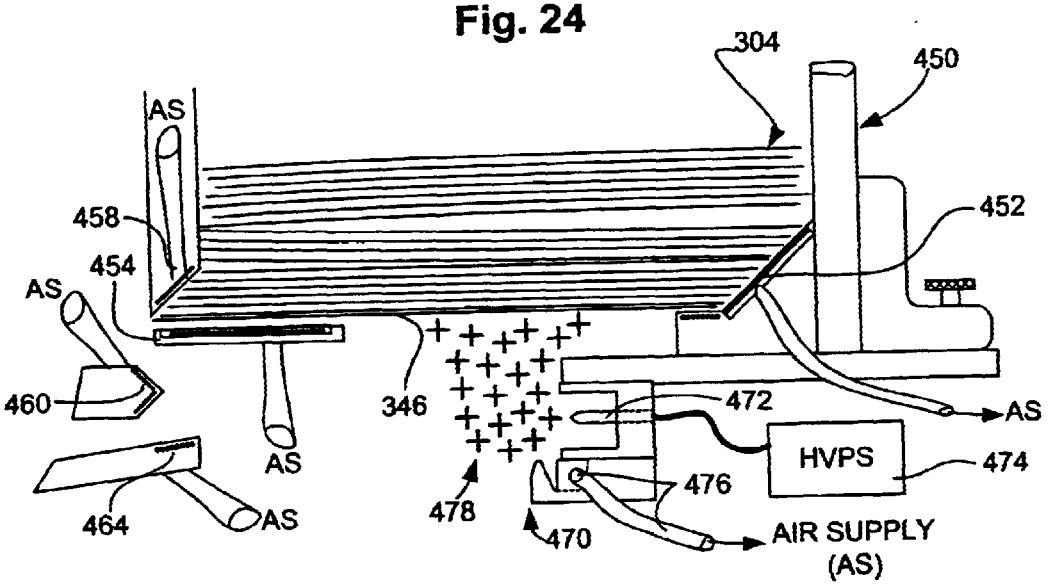

Referring to FIGS. 24 and 25, the hopper assembly 450 includes a number of air sources (AS) that distribute air via ports or other channels. These ports or channels are (in this example) located on some or all of the following components: the back guide 452; side guides 454 and 456; front guide 458; hold-down fingers 460 and lower shelves 462 and 464. In this example, the ports are a series of appropriately sized and placed pinholes on each component where it confronts the stack 304 or bottom sheet 346.

Another force that causes the sheets in the hopper to adhere together, and not singulate, is static electricity. It is well-known, that rubbing and/or sliding components together causes a triboelectric effect that introduces opposite charges on each sheet, and thus develops an attraction force therebetween. Ionization of the hopper material solves static problems by increasing the conduction and dissipates any attempt to build up charge. As shown for example in FIG. 25, the hopper area 450 is uniquely provided with an anti-static bar or ionizer 470 consisting of an electrode 472 interconnected to a high-voltage power supply (HVPS) 474. An optional air supply and distributor 476 enhances flow of ionized particles towards the bottom sheet 346 and associated stack 304.

Figure 26:
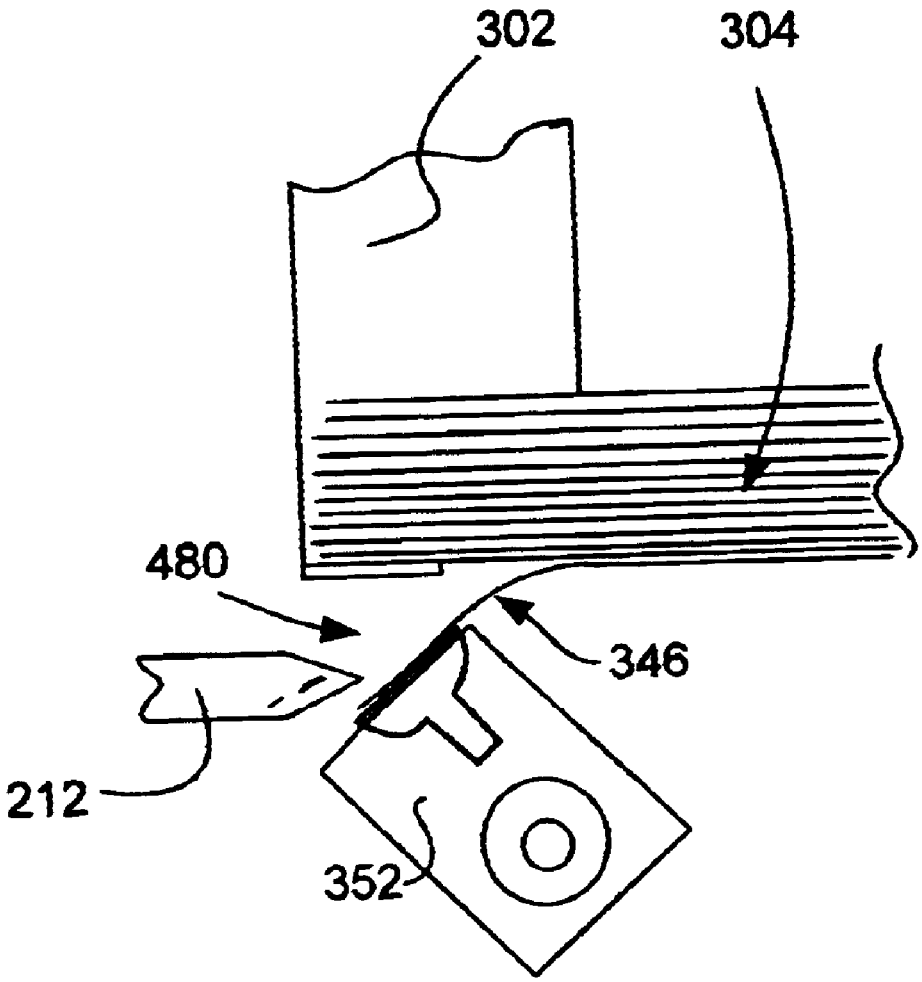
FIG. 26 is a side cross section of the sucker assembly and a hold-down finger in motion featuring a timing sequence according to an embodiment of this invention.

With general reference to the hold-down finger 212, it recedes as the sucker block rotates down. It is recognized that with correct timing of the receding finger, it can flick the edge of the sheets upwardly to further aid in inducing sheet separation. Referring to an embodiment detailed in FIG. 26, the finger 212 is brought inward (arrow 480) at a time at which it can intercept the bottom sheet 346 as shown during the sucker's downward singulation movement. Such timing can be accomplished using an appropriate cam or other linkage (not shown) that is properly sized and timed to the general rotation of inserter components (such as the shaft 194 about its associated pivot point).

Figure 27:
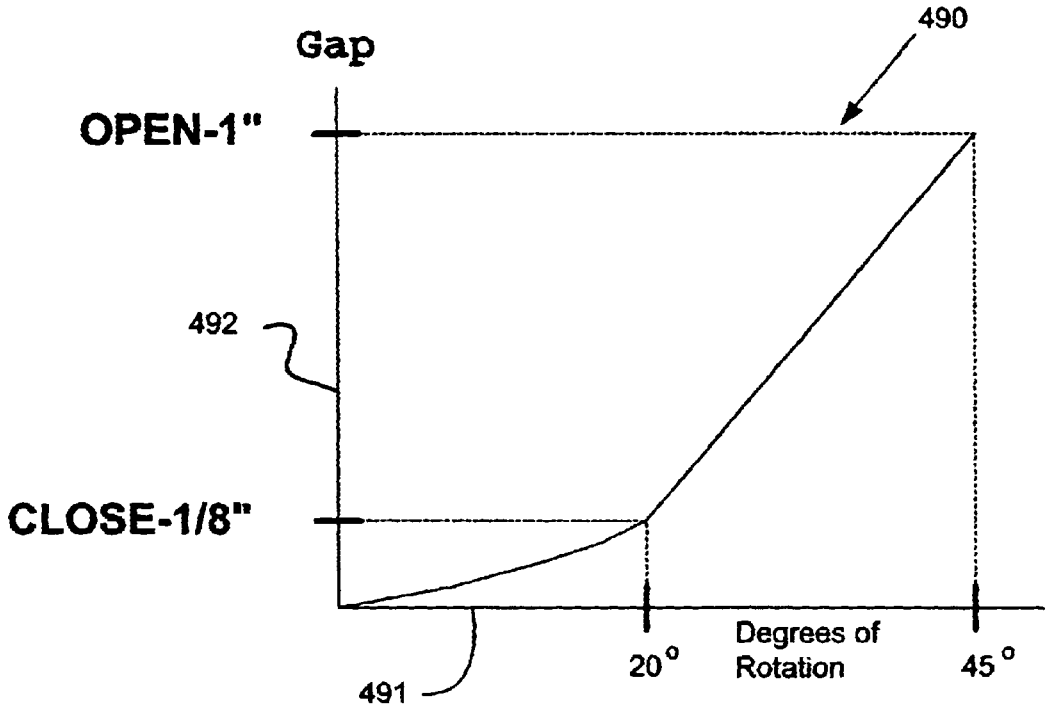
FIG. 27 is a graph of sucker position versus an actuating cam position according to an embodiment of this invention.

Finally, it has been recognized that the amount of local sheet-to-sheet vacuum force (not to be confused with sucker vacuum) between the peeling sheets is generally proportional to the acceleration of the sheets away from each other. To minimize this phenomenon, in an illustrative embodiment, the sucker's peeling motion is slower in the first few degrees of rotational motion. This reduces the local sheet-to-sheet vacuum force between the sheets, gives more time for air to flow between the sheets, and reduces the sheet-to-sheet vacuum forces. If this sheet-to-sheet vacuum is not adequately dissipated, it is likely that additional sheets will follow the bottom sheet as it is peeled down by the sucker. FIG. 27 shows a graph 490 of rotation of the sucker block according to an illustrative embodiment. A constant-rotating-speed eccentric cam (not shown) is used to rotate the sucker assembly with respect to other inserter drive components. According to the graph, during the first 20 degrees of cam rotation (Degree of Rotation 491), the sucker block is only moved approximately ⅛ inch (Gap 492). This allows air to enter the space created between the bottom sheet and the second, adjacent sheet. During the next 25 degrees of rotation, the gap separates an additional ⅞ of an inch. This is possible because the interaction of the sheets is greatly reduced by the pervious introduction of atmospheric air into the sheet-to-sheet vacuum area.

The foregoing has been a detailed description of illustrative embodiments of this invention. Various modifications and additions can be made without departing from the spirit and the scope of this invention. For example, the exemplary inserter shown and described can be substituted with another inserter. The general mechanisms can be substituted. Significantly, the sheets shown and described herein can be a variety of stackable materials constructed of paper, cloth, metal or any other acceptable material. The term "sheet" or "sheet-like material" is used broadly herein to refer to any such material. Having now described several methods and several embodiments of the present invention along with certain variations thereof, it should be apparent to those skilled in the art that various modifications and additions and other embodiments will also fall within the spirit and scope of, without departing from, the present invention as defined by the following claims. Different arrangements of sheet singulating devices may be used. Plucker locating components (380, 382 and 212) in alternate embodiments could be composed of; or constructed with, one or more elements such as various types of belts, rollers, air-bearings, geometry or brushes. These elements in conjunction with actuators or vibrators can be made to position, locate and hold the singulated sheet in a known location that is otherwise not in the proper location for the plucker (elements 220, 222, and 224). Accordingly, this description is meant only to be taken by way of example and not to otherwise limit the scope of the invention.

What is claimed is:

1. A hopper for a stack of sheet-like materials adapted to be drawn from a bottom of the stack by a sucker assembly for delivery to a predetermined element of a utilization device comprising:

a hopper formed of substantially parallel first and second guides extending at an acute angle from a supporting surface for the stack;

a pneumatic sucker assembly acting on the bottom sheet of the stack;

wherein the parallel portion of the first guide extends from the surface a shorter distance than the parallel portion of the second guide extends from the surface, the second guide ends in an angled portion to form a wider opening for passing of the sheets;

whereby the sheets are supported in the narrowing gap between the guides to reduce the pressure exerted on the surface by the stack.

2. The hopper as set forth in claim 1 wherein the rear bottom edge includes a short ledge for supporting a rear edge of the bottom of the stack.

3. The hopper as set forth in claim 2 further comprising side guides adjacent to the front guide, the side guides including inwardly directed shelves for supporting respective edges of the stack.

4. The hopper as set forth in claim 3 wherein the shelves are each angled inwardly in a reward direction from the front guide to the back guide.

5. The hopper as set forth in claim 4 further comprising a roller engaging the bottom of the stack between the short ledge and the front guide for further support of the stack.

6. The hopper as set forth in claim 1 further comprising ports at predetermined positions thereon for directing air at edges of the stack so as to break adhesion between the sheet-like materials of the stack.

7. The hopper as set forth in claim 6 wherein the ports are located on at least one of the rear bottom edge and the front bottom edge.

8. The hopper as set forth in claim 1 wherein the stack defines a material length parallel to the front guide and the rear guide and the material length is greater than the rear bottom edge.

9. The hopper as set forth in claim 1 further comprising an anti-static unit directed at the bottom of the stack.

10. The hopper as set forth in claim 1 wherein the sucker assembly comprises a block having a recess that receives a suction cup therein and is surrounded at least in part by portions of a top face, the block being adapted to engage the bottom of the stack to that the top face protrudes into and moves the bottom of the stack during a singulating cycle.

11. The hopper as set forth in claim 10 further comprising lower shelves that contact each sheet-like material as it is drawn from the stack by the sucker assembly, the shelves including non-parallel inward-facing ends so as to minimize wedging of sheets thereinto.

12. The hopper as set forth in claim 11 further comprising a first movable hold-down finger that engages the sheet-like material as it is drawn into the lower shelves, the hold down finger being adapted to move against the sheet-like material so as to flick an adjacent sheet like material to the sheet-like material engaging the sucker assembly upwardly toward the bottom of the stack.

13. The hopper as set forth in claim 11 further comprising a second movable hold-down finger that moves in conjunction with the first movable hold-down finger.

14. The hopper as set forth in claim 10 wherein the block is located off center with respect to a centerline taken along a length of the stack between opposing stack edges thereof, the centerline being parallel to the front guide and the rear guide.

15. The hopper as set forth in claim 10 further comprising another sucker block located remote from the sucker block and engaging the bottom of the stack in conjunction with the sucker block.

16. The hopper as set forth in claim 15 wherein the sucker block and the other sucker block are constructed and arranged so that the sucker block engages the bottom of the stack at a time and with a degree of protrusion both different than a time and degree of protrusion of the other sucker block.

17. The hopper as set forth in claim 10 wherein the sucker block is adapted to rotate away from the bottom of the stack, and draw therewith a sheet-like material, at an initial slower rate and a subsequent faster rate so as to enable air to fill a space between the sheet-like material and an adjacent sheet-like material during rotation at the slower rate.

18. The hopper as set forth in claim 1 wherein at least one of the rear bottom edge and the front bottom edge includes a rolling member or guiding and directing a bottom portion of the stack.

19. The hopper as set forth in claim 18 wherein the rolling member includes a motor operatively connected to the rolling member for driving the rolling member to urge the sheets in a desired direction.

20. The hopper as set forth in claim 1 wherein the hopper includes at least one of a brush, an air bearing and a driven rolling member that engage the stack so as to reduce friction on the stack as the sheet-like materials are directed toward the bottom of the stack.

* * * * *